US009932736B2

(12) United States Patent
Ryan et al.

(10) Patent No.: US 9,932,736 B2
(45) Date of Patent: Apr. 3, 2018

(54) TUNABLE SPECULAR ACOUSTIC DECK

(71) Applicant: Epic Metals Corporation, Rankin, PA (US)

(72) Inventors: Thomas G. Ryan, Ligonier, PA (US); David F. Landis, Murrysville, PA (US)

(73) Assignee: Epic Metals Corporation, Rankin, PA (US)

( * ) Notice: Subject to any disclaimer, the term of this patent is extended or adjusted under 35 U.S.C. 154(b) by 0 days.

(21) Appl. No.: 15/172,253

(22) Filed: Jun. 3, 2016

(65) Prior Publication Data

US 2016/0356036 A1 Dec. 8, 2016

Related U.S. Application Data

(60) Provisional application No. 62/170,360, filed on Jun. 3, 2015.

(51) Int. Cl.

| | |
|---|---|
| ***E04B 1/99*** | (2006.01) |
| ***E04B 9/00*** | (2006.01) |
| ***G10K 11/16*** | (2006.01) |
| ***G10K 11/172*** | (2006.01) |
| *E04B 9/34* | (2006.01) |

(52) U.S. Cl.

CPC ..... *E04B 1/994* (2013.01); *E04B 9/001* (2013.01); *G10K 11/16* (2013.01); *G10K 11/172* (2013.01); *E04B 9/003* (2013.01); *E04B 9/34* (2013.01)

(58) Field of Classification Search

CPC . E04B 1/994; E04B 9/34; E04B 9/001; E04B 9/003; G10K 11/172; G10K 11/16

USPC ..... 52/144

See application file for complete search history.

(56) References Cited

U.S. PATENT DOCUMENTS

| | | | | |
|---|---|---|---|---|
| 3,049,190 A | | 8/1962 | Coffman | |
| 3,072,183 A | | 1/1963 | Barbier et al. | |
| 3,382,947 A | * | 5/1968 | Biggs | E04B 1/994 181/30 |
| 3,411,605 A | * | 11/1968 | Coffman | E04B 1/994 181/30 |
| 3,590,354 A | * | 6/1971 | Shiflet | E04B 1/994 181/30 |
| 3,783,968 A | * | 1/1974 | Derry | E01F 8/0052 181/210 |
| 3,812,931 A | * | 5/1974 | Hauskins, Jr. | E01F 8/0052 181/210 |
| 3,857,459 A | * | 12/1974 | Adams | E04B 1/8209 181/295 |
| 3,861,493 A | | 1/1975 | Payne | |
| 3,950,912 A | | 4/1976 | Lundberg et al. | |

(Continued)

FOREIGN PATENT DOCUMENTS

| | | | | |
|---|---|---|---|---|
| DE | 102004037909 A1 | * | 3/2006 | E04B 9/064 |
| FR | 2624640 A1 | * | 6/1989 | G10K 11/172 |

*Primary Examiner* — Babajide A Demuren

(74) *Attorney, Agent, or Firm* — The Webb Law Firm

(57) ABSTRACT

According to the present invention, an acoustic deck includes a deck member defining a cavity and a movable tunable insert disposed at least partially within the cavity of the deck member. The tunable insert is rotatable or translatable relative to the deck member to alter acoustic effects of the acoustic deck. The acoustic deck can be installed in a room, and the acoustic tunable insert rotated or translated in order to achieve desired acoustic effects in the room. Also disclosed is a system of acoustic decks and a method of operating the acoustic deck.

25 Claims, 19 Drawing Sheets

(56) References Cited

U.S. PATENT DOCUMENTS

| | | | | |
|---|---|---|---|---|
| 4,094,379 | A * | 6/1978 | Steinberger | E04B 1/994 181/210 |
| 4,226,299 | A * | 10/1980 | Hansen | E04B 1/86 181/210 |
| 4,875,312 | A | 10/1989 | Schwartz | |
| 6,178,705 | B1 | 1/2001 | Lefebvre | |
| 6,267,347 | B1 | 7/2001 | Ryan et al. | |
| 7,146,920 | B1 | 12/2006 | Ryan et al. | |
| D552,765 | S | 10/2007 | Ault et al. | |
| 7,328,667 | B1 | 2/2008 | Ryan et al. | |
| 8,162,104 | B2 | 4/2012 | Bastion et al. | |
| D661,410 | S | 6/2012 | Ryan | |
| 2012/0247867 | A1* | 10/2012 | Yang | E04B 1/86 181/211 |

* cited by examiner

TUNABLE SPECULAR ACOUSTIC DECK

CROSS-REFERENCE TO RELATED APPLICATIONS

This application claims the benefit of U.S. Provisional Application No. 62/170,360, filed on Jun. 3, 2015, the disclosure of which is hereby incorporated in its entirety by reference.

BACKGROUND OF THE INVENTION

Field of the Invention

The present invention relates to an acoustic ceiling deck that is tunable to achieve a desired sound effect in a room.

Description of Related Art

The construction of convention centers, arenas, office buildings, and other major structures normally uses deck panels assembled in a side-by-side and/or end-to-end relationship to facilitate the construction of the structure interior. Acoustic ceiling decks have been in existence for more than 50 years. These decks reduce the reverberation of sound time in a building and the measurement method is known as a noise reduction coefficient (NRC). The NRC has a theoretical scale of 0 to 1, which is well known in the art. Specular ratings are a relatively new science, where the initial specular reflection is measured on a scale of 0 to 1 where 0 is a perfect absorber and 1 is a perfect reflector.

MBI Products Company, Inc, makes Lapendary® Panels, which are large acoustical panels hung in a loose fashion or installed flush to the roof deck. The Lapendary® Panels reduce reverberation time and sound intensity levels in harsh acoustic environments. This arrangement uses a sound absorbing element encased in fabric or polyvinylchloride (PVC) for sound control.

Epic Metals Corporation developed a product known as Envista® Specular Deck (hereinafter "Envista®") (see U.S. Pat. Nos. 7,146,920 and 7,328,667, as well as U.S. Design Pat. No. D552,765). The Envista® design provides an excellent NRC of 0.90 and a specular rating of 0.32. This is accomplished by optimizing the deck based on sound absorption area, resonator (volume and orifice), and diffusion and reflection by profile design.

SUMMARY OF THE INVENTION

In one embodiment an acoustic deck includes a deck member defining a cavity and a tunable insert disposed at least partially within the cavity of the deck member. The tunable insert is movable relative to the deck member.

The deck member can include a plurality of side walls and abuse connecting the side walls. Each of the side walls can include a distal end portion. The side walls and the base can define the cavity. The base can be positioned opposite an opening defined between the respective distal end portions of the side walls. The deck member can further include a stationary insert positioned between the base and the opening. The side walls can include a perforation. The acoustic deck can include acoustic absorption material co-acting with the base or the side walls. The deck member can include a seal proximate the opening, whereby when the seal is in contact with the tunable insert, sound waves that pass proximate the contact point of the seal and the tunable insert are affected. The acoustic absorption material can be positioned between the stationary insert and the base. A cross section of the tunable insert can be three-sided, and the tunable insert can include a perforation and acoustic absorption material co-acting with the tunable insert. A side of the tunable insert can be planar. A side of the tunable insert can be curved. The tunable insert can be cylindrical shaped and can include a perforation. The acoustic deck can include a motor co-acting with the tunable insert to rotate the tunable insert relative to the deck member. The tunable insert can be rotatable 360 degrees relative to the deck member. The tunable insert can be rotatable relative to the deck member between a plurality of set positions. The acoustic deck can further include a controller in electrical communication with the motor configured to control rotation of the tunable insert relative to the deck member to a desired position. The acoustic deck can include a bracket coupled to the tunable insert and configured to allow translation of the tunable insert along an axis relative to the deck member. The deck member can be configured to interlock with other deck members. The tunable insert can be rotatable or translatable relative to the deck member.

In another embodiment, an acoustic deck system includes a plurality of deck members, where at least one of the deck members define a cavity and a tunable insert is disposed at least partially within the cavity. The tunable insert is movable relative to the at least one deck member.

In another embodiment, a method of operating an acoustic deck includes rotating or translating a tunable insert disposed at least partially within a deck member. The deck member defines a cavity. The tunable insert is rotated or translated relative to the deck member, thereby affecting the acoustic effects of the acoustic deck.

These and other features and characteristics of the present invention, as well as other methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is also to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 18B shows a schematic view of a cam arrangement for translating the tunable insert within the deck cavity to assist in position changes and spacing; and.

DETAILED DESCRIPTION OF THE INVENTION

Figure 1:
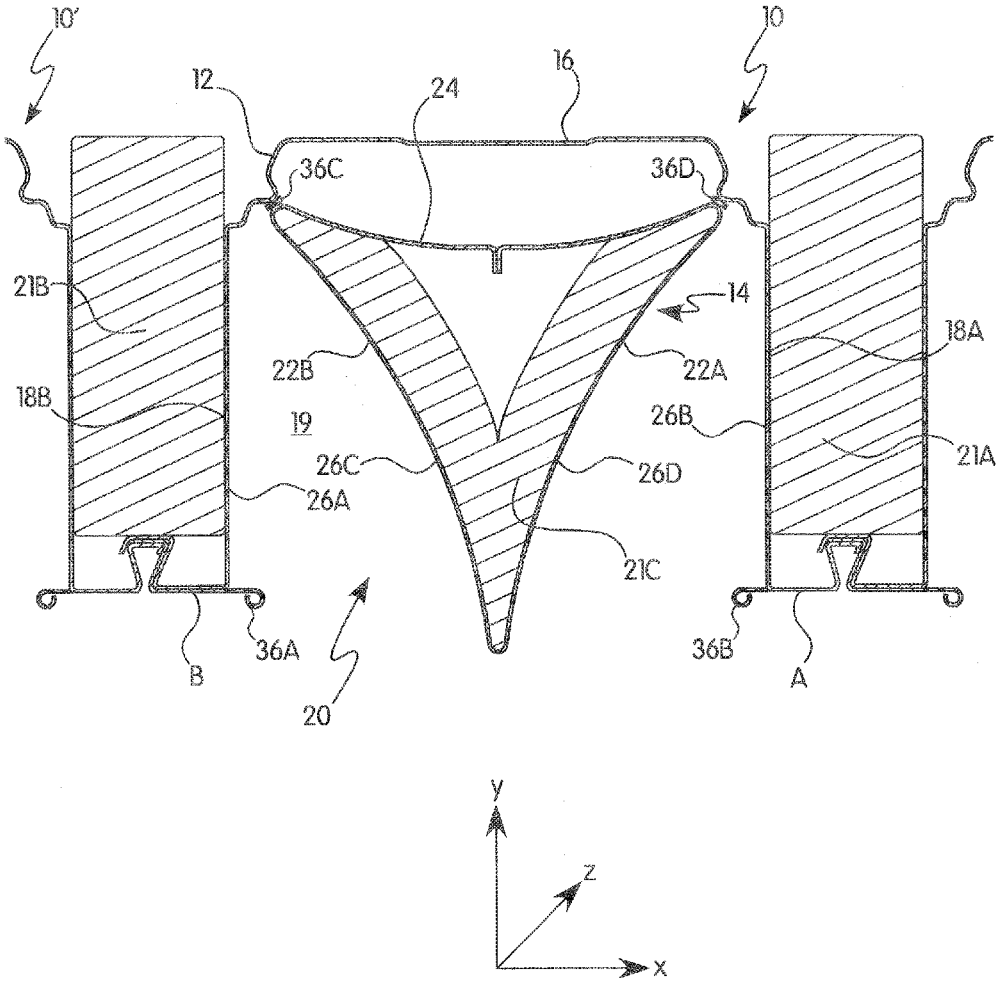
FIG. 1 shows a cross-sectional view of one embodiment of an acoustic deck having a deck member and a tunable insert according to the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification; are simply exemplary embodiments of the invention. Hence, specific dimensions and other physical characteristics related to the embodiments disclosed herein are not to be considered as limiting.

Referring to FIG. 1, an acoustic deck (10) can include a deck member (12) and a tunable insert (14). The acoustic deck (10) of the present invention is tunable in order to give a desired sound effect in a room.

The deck member (12) can have a base (16) and two side walls (18A, 18B) defining a cavity (19). The base (16) can be opposite an opening (20). The side walls (18A, 18B) can run substantially parallel to each other and substantiality perpendicular to the base (16). The side walls (18A, 18B) can intersect the base (16) to define the cavity (19'. The sidewalls (18A, 18B) can have distal end portions, with the opening defined between the respective distal end portions. In one embodiment of the present invention, the deck member (12) can be a deep deck member (12) of 9.25 inches. The deck member (12) can be interlockable in a side-by-side arrangement and/or an abutting end-to-end arrangement with other deck members (12). The deck member (12) can be made of metal. The deck member (12) may interlock with connector portions (A, B) positioned proximate the opening (20) as shown in FIG. 1.

In one embodiment, a cross section of the tunable insert (14) is a three sided tunable insert (14) that has three sides of equal length where those sides are concave sides (see FIG. 1). At least one side of the tunable insert (14) can be an acoustic side (22A, 22B) that affects acoustic properties (e.g., absorption material, perforations, etc.). Each of the side walls (18A, 18B) include respective connector portions (A, B) to enable attachment of adjacent decking and provide a closure/seal to the tunable insert (14). In one embodiment, like in FIG. 1, two of the sides of the tunable insert (14) can be acoustic sides (22A, 22B), and the third side can be a non-acoustic side (24). In one embodiment, all sides of the tunable insert (14) can be acoustic sides (22) or all sides can be non-acoustic sides (24). The tunable insert (14) can take shapes other than that shown in FIG. 1, and several possible alternate shapes will be discussed later.

The acoustic deck can include seal portions (36A-36D) made of rubber or other elastic material. Seal portions (36A, 36B) can be disposed on the connector portions (A, B) proximate the opening (20) of the acoustic deck (10). The seal portions (36A, 36B) can extend far enough into the opening (20) so that the seal portions (36A, 36B) can come into contact with the tunable insert (14) as it translated toward the opening (20). The seal portions (36A. 36B) can flex when co-acting with the translatable insert (14). Seal portions (36C, 36D) can be disposed on the base (16) and can come into contact with the tunable insert (14) as the tunable insert. (14) is translated toward the base (16).

Perforated acoustic surfaces (26A-26D) can be provided in the acoustic deck (10). A perforated acoustic surface (26A-26D) contains at least one perforation, but preferably a plurality of perforations, over the area of the surface to achieve improved acoustic properties compared to a non-acoustic surface. The acoustic sides (22A, 22B) of the tunable insert (14) can be perforated acoustic surfaces (26C, 26D). The perforated acoustic surfaces (26C, 26D) of the tunable insert (14) can include an acoustical element, such as sound absorption material (21A-21C), co-acting with the perforated acoustic surfaces (26C, 26D). In some embodiments, a spacer (not shown) may be used to keep the sound absorption material (21A-21C) off of the perforated acoustic surfaces (26C, 26D) so that the perforations do not get clogged. In some embodiments, the sound absorption material (21A-21C) may be fiberglass of a density to absorb sound. In some embodiments, rock wool and/or denim absorption material may be used. However, it is noted that the sound absorption material (21A-21C) may be any material suitable for trapping, isolating, and controlling sound waves. Additionally, both side walls (18A, 18B) of the deck member (12) can be perforated acoustic surfaces (26A, 26B) and can include acoustic sound absorption material (21A, 21B) co-acting with the perforated acoustic surfaces (26A, 26B). The non-acoustic side (24) of the tunable insert (14) is not a perforated acoustic side (26C, 26D).

The acoustic deck (10) can be arranged such that at least part of the tunable insert (4) disposed within the cavity (19) of the deck member (12), as shown, for example, in FIG. 1. The tunable insert (14) can be used with any shape of deck member (12) defining a cavity (19). The acoustic deck (10) can be configured in this manner throughout the entire room to achieve a desired sound effect of the room. Alternatively, the acoustic deck (10) can be configured in this manner in only a section of the room to achieve the desired sound effects of the room.

The tunable insert (14) can be rotatable about the z-axis of FIG. 1 relative to the deck member (12). The z-axis may run longitudinally along the tunable insert (14) and be disposed within the cavity (19) of the deck member (12) during rotation of the tunable insert (14). The tunable insert (14) can also be translatable along the x-axis or y-axis of FIG. 1 relative to the deck member (12). The x-axis or y-axis may intersect the z-axis. Rotating the tunable insert (14) allows for the acoustic properties of the acoustic deck (10) to be tuned based on the sound effect desired for the room in which the acoustic deck (10) is located. At certain angles, the acoustic deck (10) can have reflective properties, while at other angles the acoustic deck (10) can have sound-absorbing properties. Acoustic properties of the room can be altered by rotating the tunable insert (14) of the acoustic deck (10) so that different surface areas of perforated acoustic surfaces (26A-26D) can be exposed and the angles of the acoustic deck (10) off which the sound waves bounce can be altered.

Referring to FIG. 1, the acoustic deck (10) can be interlocked with adjacent acoustic decks in a side-by-side arrangement. Seal portions (36A, 36B) of connector portions (A, B) may be made of flexible material, such as rubber or other elastic material, to make a tight seal with the tunable insert (14). The seal portions (36A, 36B) of the connector portions (A, B) being flexible allow the tunable insert (14) to bend or rotate by bending the seal portions (36A, 36B) of the connector portions (A, B).

Figure 2:
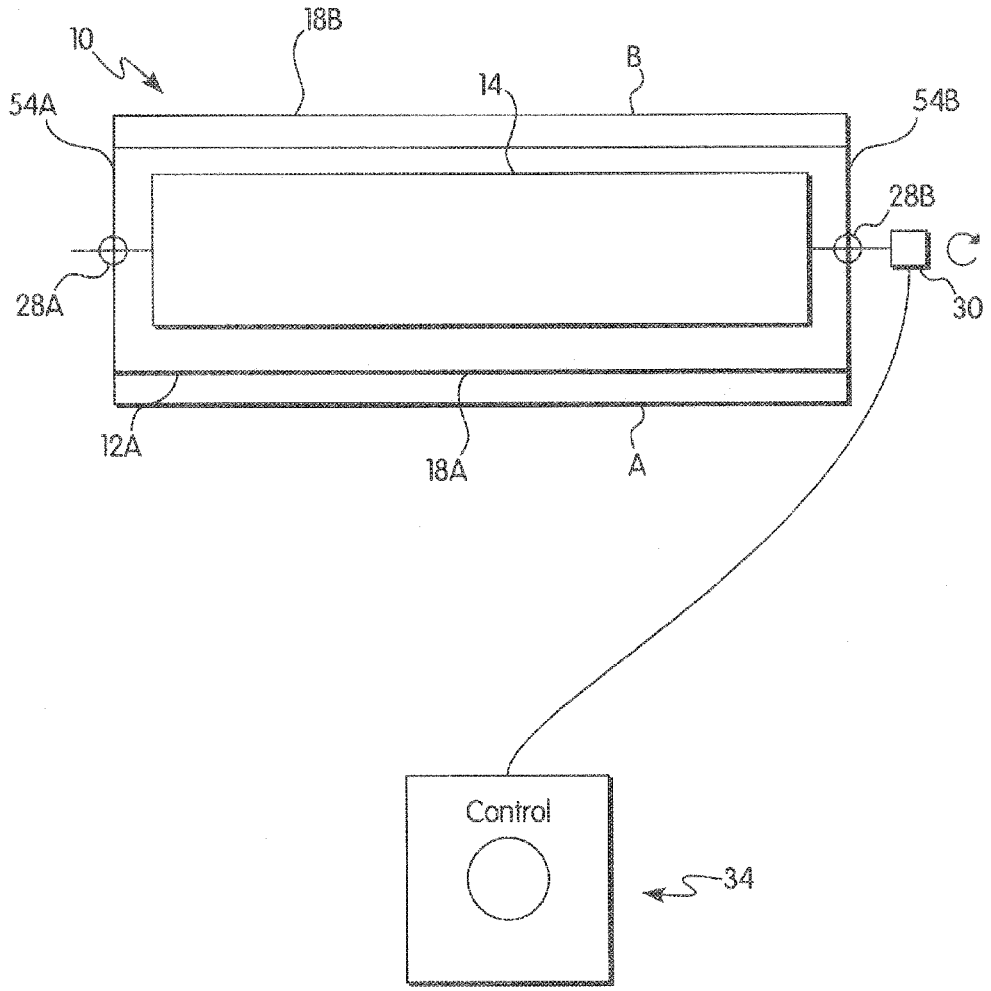
FIG. 2 shows a schematic view of a system for rotating the tunable insert in the deck member.

Referring to FIG. 2, a system to rotate the tunable insert (14) to its desired position can be provided. The tunable insert (14) can be rotated about bearings (28A, 28B) provided on each end of the tunable insert (14). The system can include a motor (30), such as a commercial 12-volt DC gear motor to effect the rotation of the tunable insert (14). The motor (30) can be in electrical communication with a controller (34). The motor (30) can receive a signal from the controller (34), which communicates to the motor (30) when to rotate the tunable insert (14) and in what direction to rotate the tunable insert (14). An operator can use the controller (34) to adjust the position of the tunable insert (14) to the desired position to give the room the desired sound effects.

In one embodiment, there are twelve basic positions of rotation of the tunable insert (14) (30 degree increments), which have unique sound characteristics. The present invention is not limited to only these twelve basic positions, as the tunable insert (14) can be rotated to angles between the 30 degree increments (i.e., the tunable insert (14) is rotatable among any number of set positions). The tunable insert (14) can rotate 360 degrees about the z-axis (FIG. 1). Additionally, further positions can be provided by translating the tunable insert (14) along an axis, such as about the y-axis (FIG. 1).

FIGS. 3A-14B show the acoustic deck (10) having the above-described twelve basic rotational positions of rotation of the tunable insert (14). The positions are designated by clock hours with the center seam of the non-acoustic side (24) of the tunable insert (14) being the hour hand. For instance, FIG. 1 corresponds to the 12 o'clock position because the center seam of the non-acoustic side (24) of the tunable insert (14) points to the 12 o'clock hour. Each of the basic positions will be briefly described below in terms of their effects on the acoustic properties of the acoustic deck (10) for the tunable insert (14) shown in FIGS. 3A-14B.

Figure 3A:
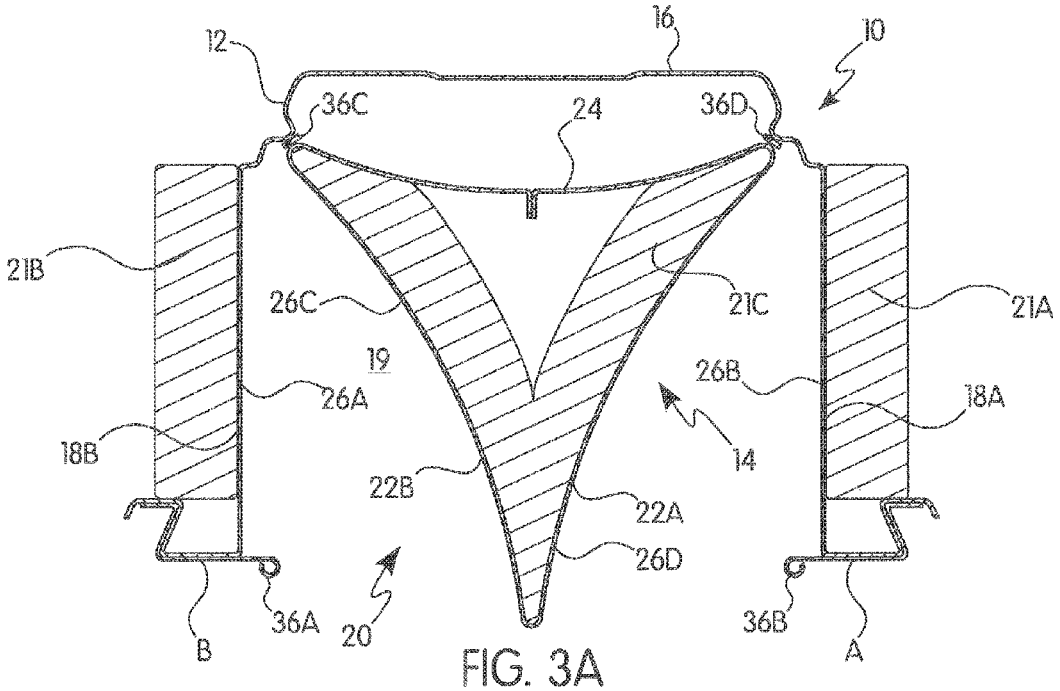
FIG. 3A shows across-sectional view of one embodiment of the tunable insert in its 12 o'clock up position.

FIG. 3A shows the tunable insert (14) in the 12 o'clock up position. This position provides two sides of absorption area along the acoustic sides (22A, B) of the tunable insert (14) with a controlled resonator for excellent NRC (nearly identical to the 0.90 rating of the Envista® Specular Deck), as well as a profile to reflect or diffuse the sound to the acoustic deck to acquire excellent specular coefficients (nearly identical to the 0.32 rating of the Envista® Specular Deck).

Figure 3B:
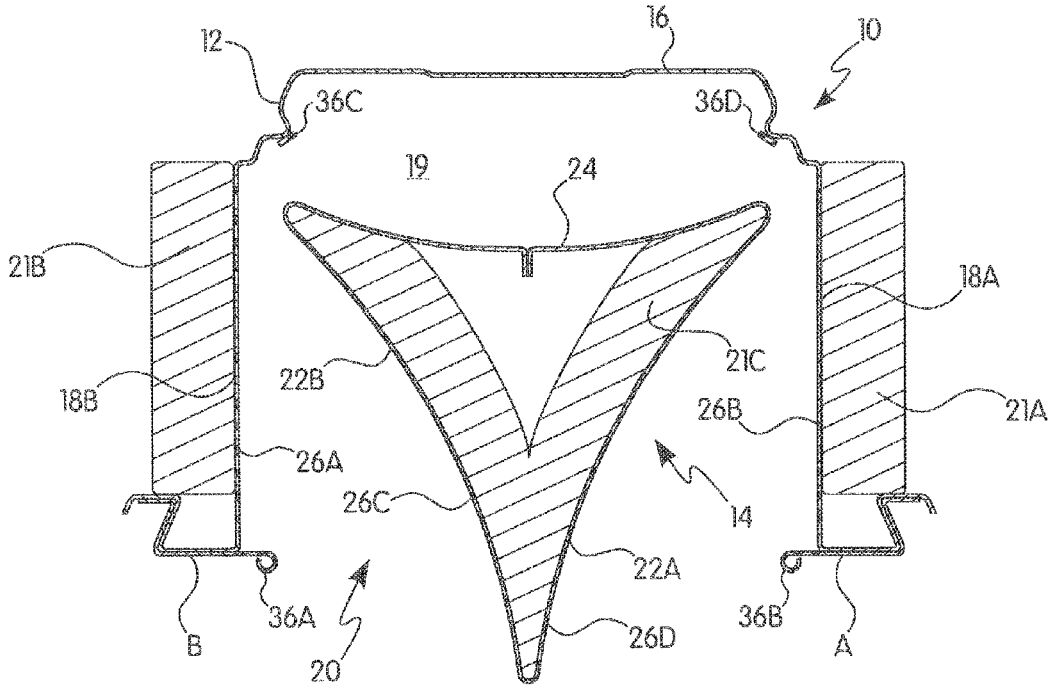
FIG. 3B shows across-sectional view of one embodiment of the tunable insert in its 12 o'clock down position.

FIG. 3B shows the tunable insert (14) in the 12 o'clock down position. This position allows the tunable insert (14) to be more exposed than in the 12 o'clock up position for specular absorption and eliminates the resonator for NRC performance. The 12 o'clock down position is translated vertically down in the y-direction from the 12 o'clock up position.

Figure 4A:
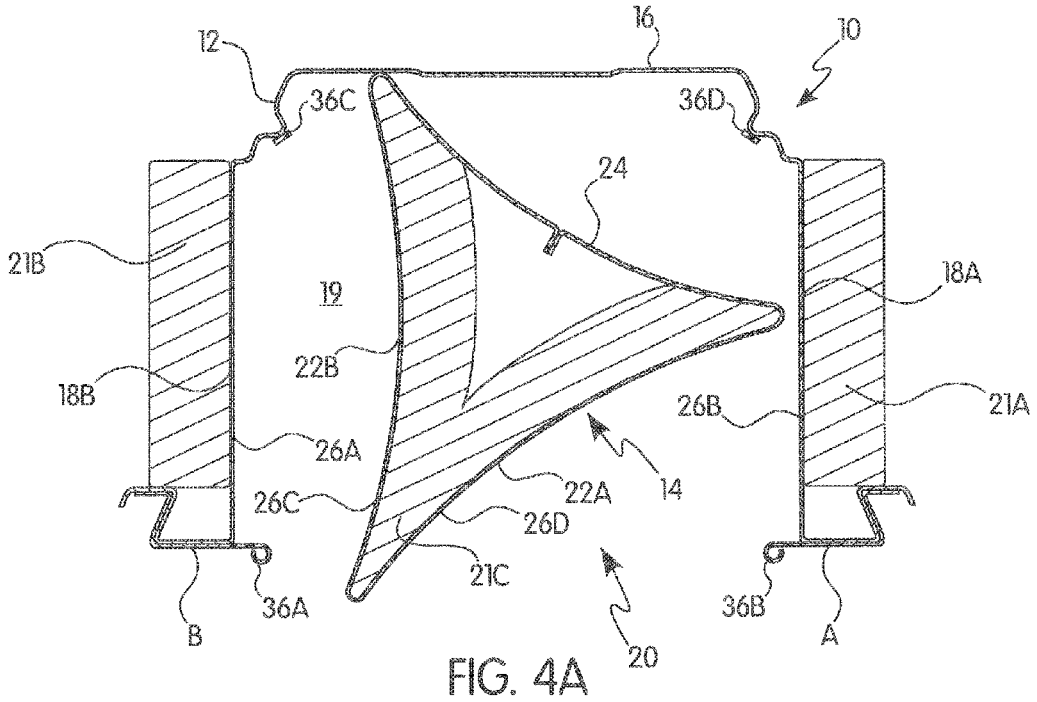
FIG. 4A shows a cross-sectional view of one embodiment of the tunable inserting its 1 o'clock mid position.

FIG. 4A shows the tunable insert (14) in the 1 o'clock mid position. This position favors specular absorption from the right side and less from perpendicular incidence. The NRC would not change much from the 12 o'clock down position except for the effect of a newly formed resonator determining a specific peak absorption frequency.

Figure 4B:
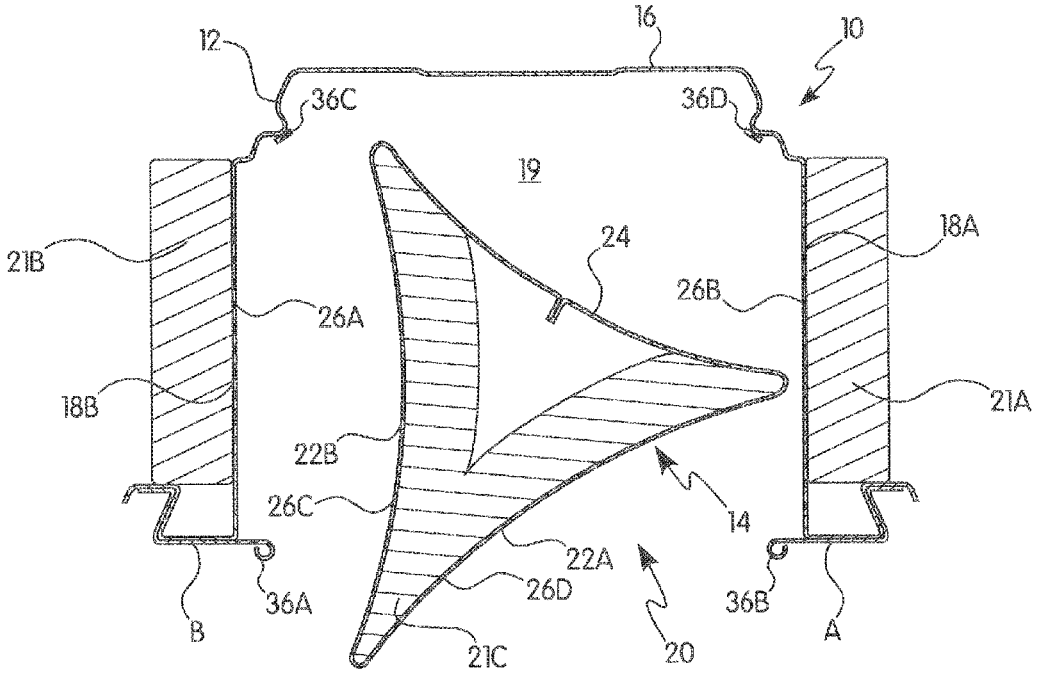
FIG. 4B shows across-sectional view of one embodiment of the tunable insert in its 1 o'clock down position.

FIG. 4B shows the tunable insert (14) in the 1 o'clock down position. This position provides more direct exposure from the right side compared to the 1 o'clock mid position, further improving the absorption with less specular reflection. The NRC would also change due to the degrading of the resonator. The 1 o'clock down position is translated vertically down in the v-direction from the 1 o'clock mid position.

Figure 5:
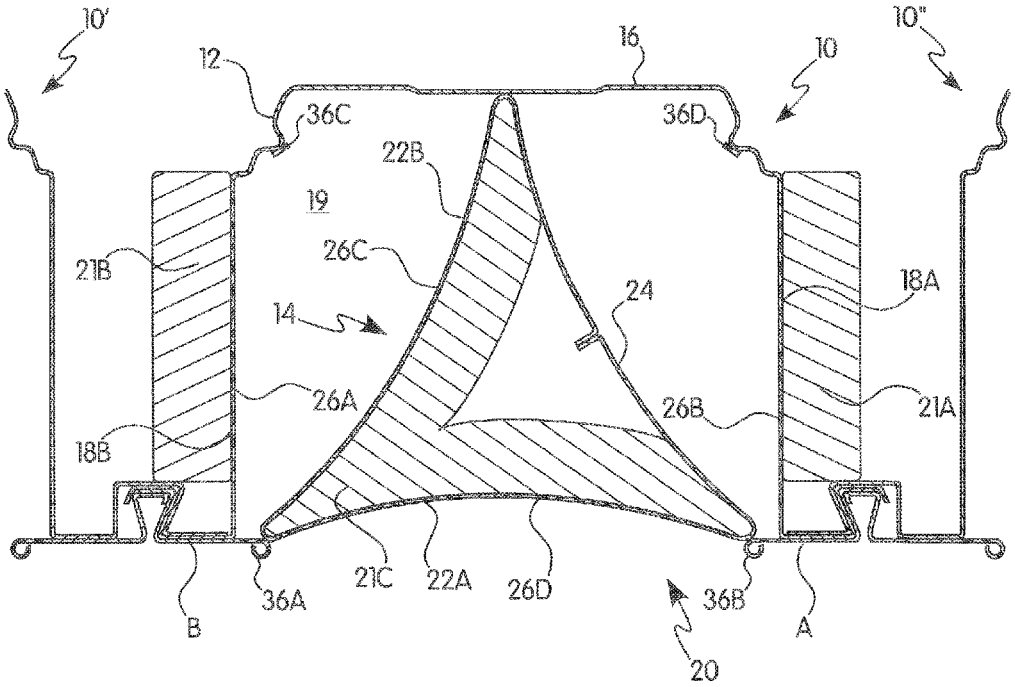
FIG. 5 shows a cross-sectional view of one embodiment of the tunable insert in its 2 o'clock position.

FIG. 5 shows the tunable insert (14) in the 2 o'clock position. This position eliminates all direct reflection paths to the deck member (12). A series of absorber-resonators are created to the left side. The specular results are governed by less absorption area and no diffusion or internal reflections. The NRC diminishes compared to the previous position as there is less absorption area and two resonators are created. Like in FIG. 1, the embodiment shown in FIG. 5 can include the acoustic deck (10) interlocked with adjacent acoustic decks (10', 10") in a side-by-side arrangement. The tunable insert (14) shown in FIG. 5 may rotate or translate by first lowering the tunable insert (14). The seal portions (36A, 36B) of the connector portions (A, B) may be made of flexible material, such as rubber or other elastic material, to make a tight seal with the tunable insert (14). The seal portions (36A, 36B) of the connector portions (A, B) being flexible allow the tunable insert (14) to bend or rotate by bending the seal portions (36A, 36B) of the connector portions (A, B).

Figure 6A:
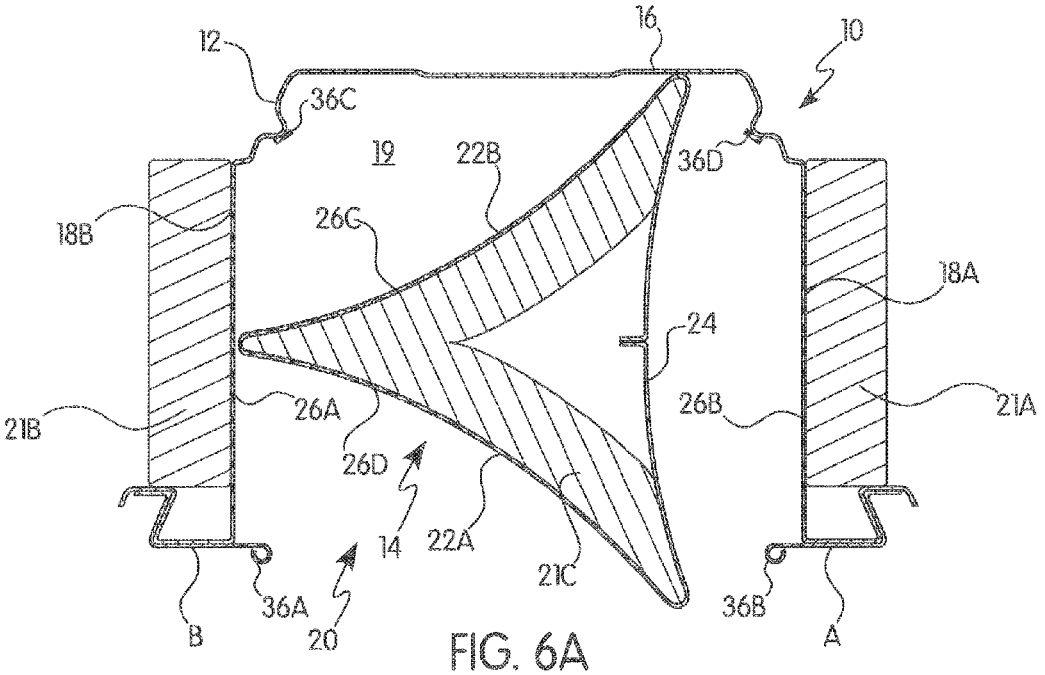
FIG. 6A shows across-sectional view of one embodiment of the tunable insert in its 3 o'clock mid position.

FIG. 6A shows the tunable insert (14) in the 3 o'clock mid position. This position has a specular reflection that is sensitive to absorption and a combination of reflection-absorption from the right. For noise, there is adequate absorption area for a higher NRC from the previous position and a resonator tuned to a different frequency.

Figure 6B:
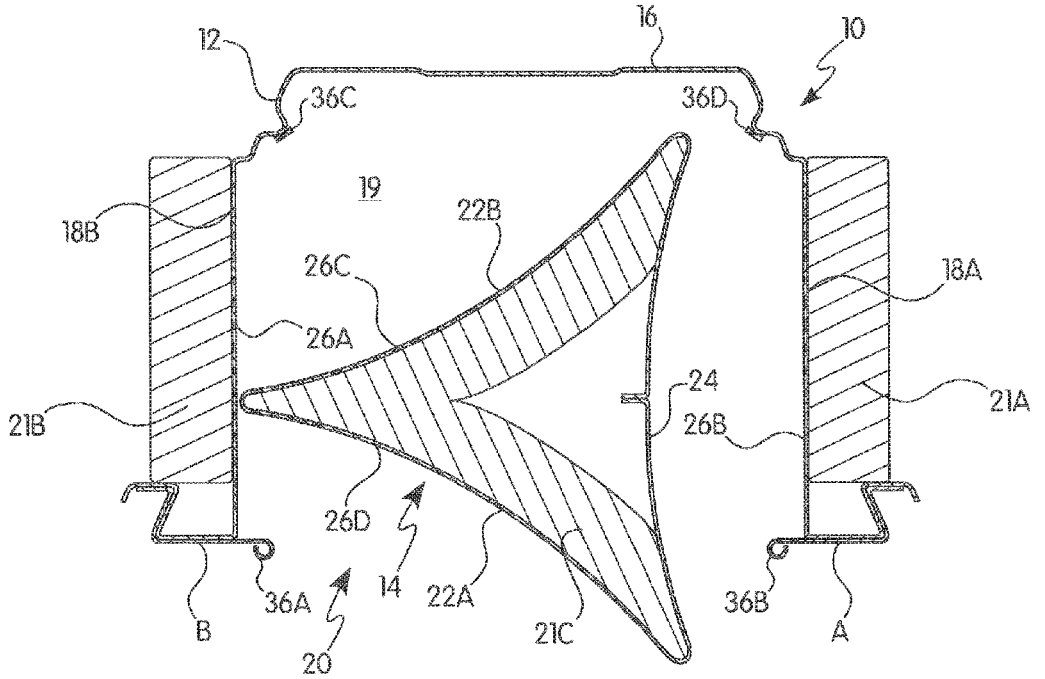
FIG. 6B shows a cross-sectional view of one embodiment of the tunable insert in its 3 o'clock down position.

FIG. 6B shows the tunable insert (14) in the 3 o'clock down position. This position is similar to the 3 o'clock mid position but has more exposure to specular. The NRC remains nearly the same as the 3 o'clock mid position except for the deterioration of the resonator. The 3 o'clock down position is translated vertically down in the y-direction from the 3 o'clock mid position.

Figure 7A:
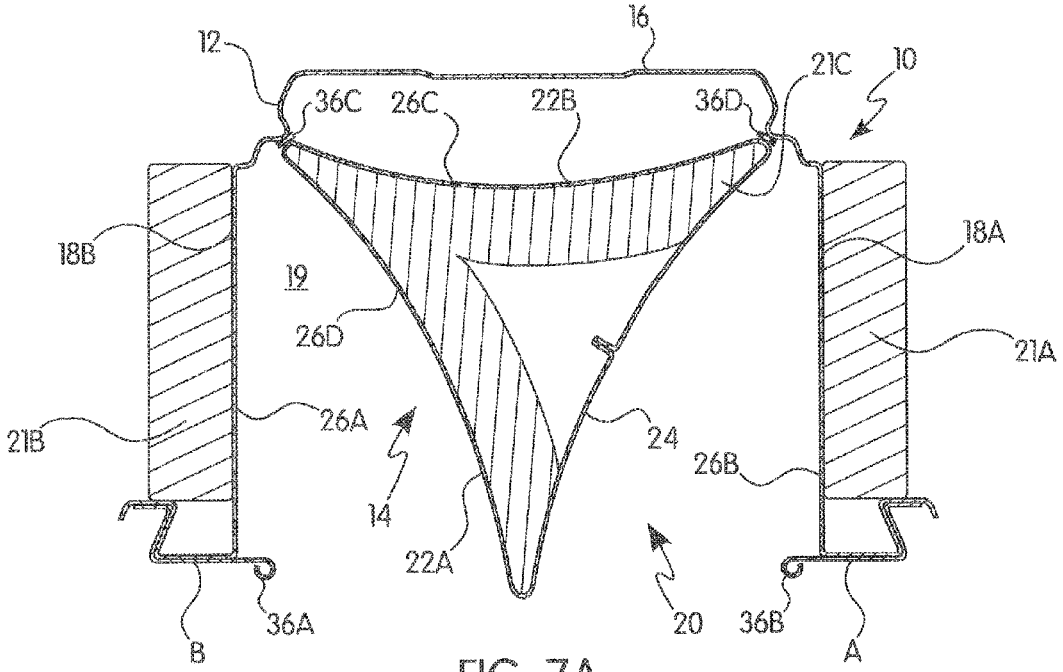
FIG. 7A shows a cross-sectional view of one embodiment of the tunable insert in its 4 o'clock up position.

FIG. 7A shows the tunable insert (14) in the 4 o'clock up position. This position has specular reflections that are clearly divided with absorption on the left and reflection on the right, with each subjected to internal reflection-absorption by the deck member (12). Adequate absorption area is provided for a high NRC (higher compared to the 2 o'clock position). A new resonator is created, possibly affecting peak absorption frequency.

Figure 7B:
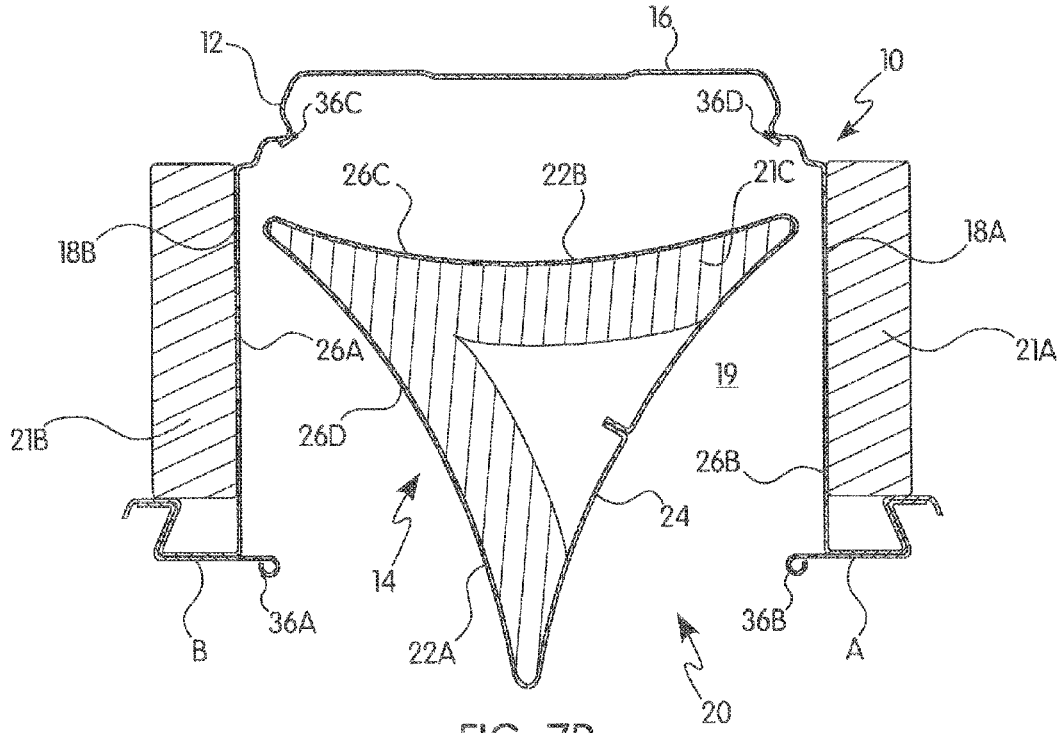
FIG. 7B shows a cross-sectional view of one embodiment of the tunable insert in its 4 o'clock down position.

FIG. 7B shows the tunable insert (14) in the 4 o'clock down position. This position is nearly the same as the 4 o'clock up position, except that it has greater exposure for specular and deterioration of the resonator for NRC. The 4 o'clock down position is translated vertically down in the y-direction from the 4 o'clock up position.

Figure 8A:
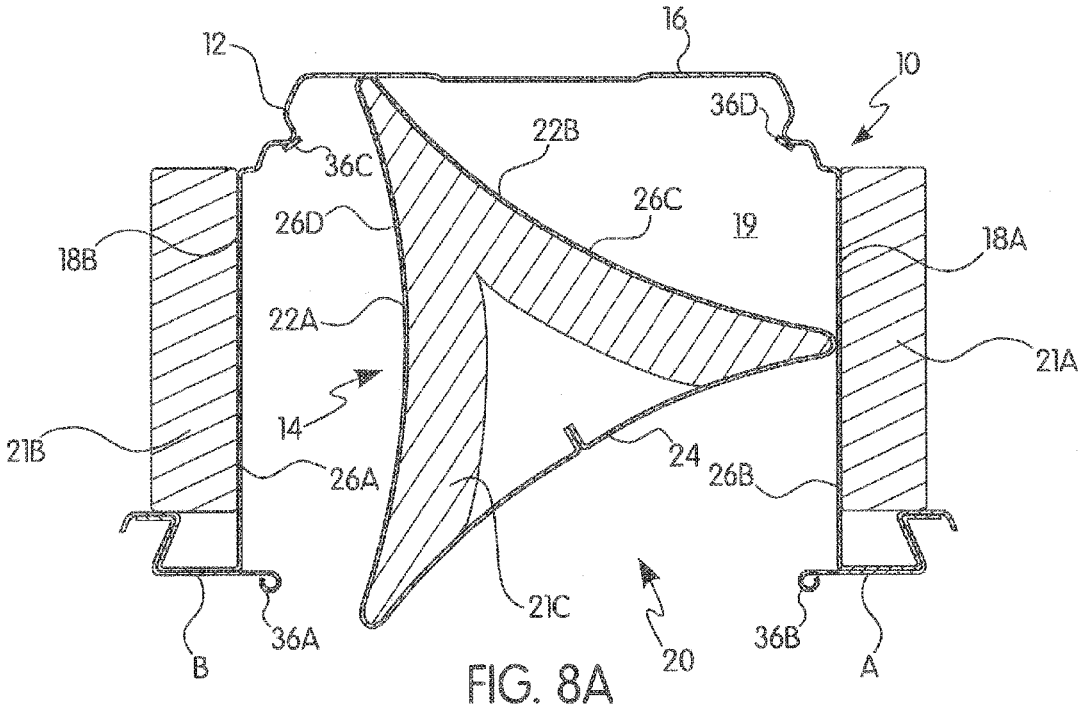
FIG. 8A shows a cross-sectional view of one embodiment of the tunable insert in its 5 o'clock mid position.

FIG. 8A shows the tunable insert (14) in the 5 o'clock mid position. This position provides high specular reflection from a sound source to the right and minor absorption or reflection, but possible high internal diffusion from a sound source to the left.

Figure 8B:
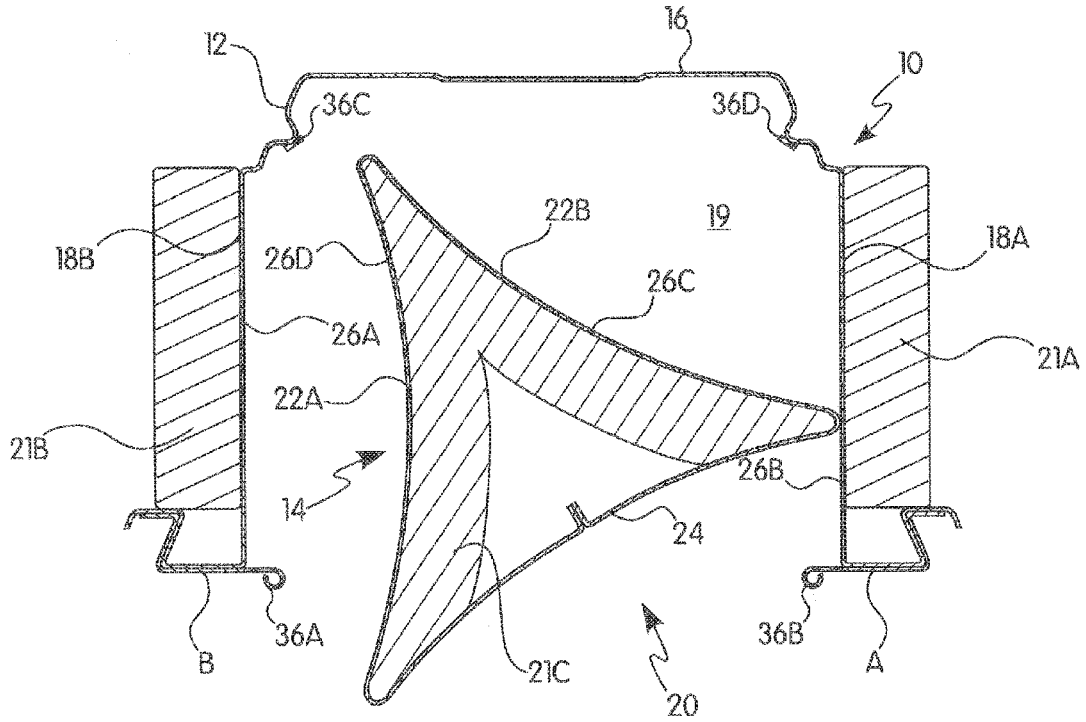
FIG. 8B shows a cross-sectional view of one embodiment of the tunable insert in its 5 o'clock down position.

FIG. 8B shows the tunable insert (14) in the 5 o'clock down position. This position provides greater exposure for specular compared to the 5 o'clock mid position. The NRC would be greater than the 5 o'clock mid position since all acoustical surfaces are exposed to noise. The 5 o'clock down position is translated vertically down in the y-direction from the 5 o'clock mid position.

Figure 9:
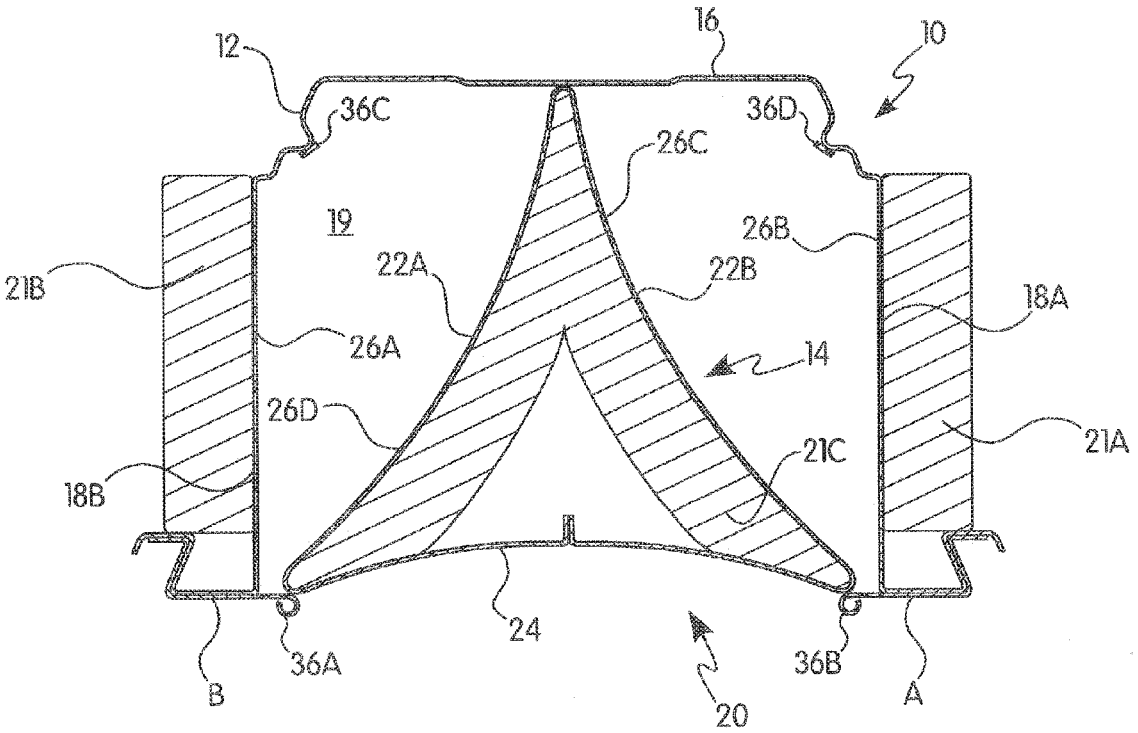
FIG. 9 shows a cross-sectional view of one embodiment of the tunable insert in its 6 o'clock position.

FIG. 9 shows the tunable insert (14) in the 6 o'clock position. This position generates the highest specular reflection and the lowest NRC of any potential position of the tunable insert (14). All acoustic surfaces are blocked from the direct sound source or noise. The tunable insert (14) shown in FIG. 9 may rotate or translate by bending the seal portions (36A, 36B) of the connector portions (A, B) as previously described.

Figure 10A:
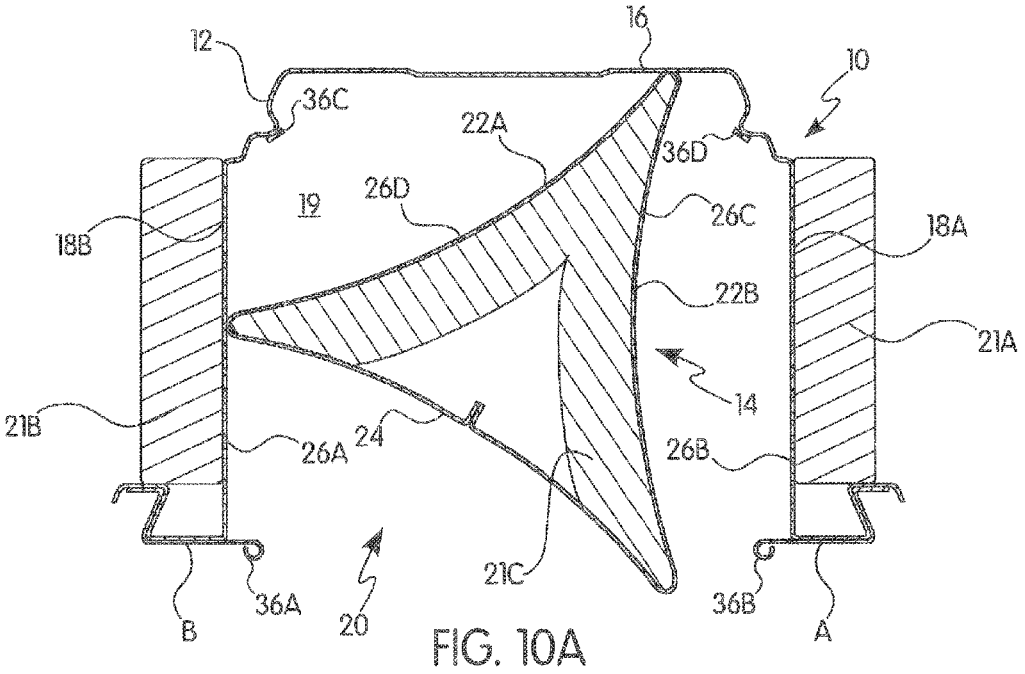
FIG. 10A shows a cross-sectional view of one embodiment of the tunable insert in its 7 o'clock mid position.

FIG. 10A shows the tunable insert (14) in the 7 o'clock mid position. This position is a mirror image of the 5 o'clock mid position (i.e., the tunable insert (14) shown in FIG. 10A is flipped about the vertical axis compared to the tunable insert (14) in FIG. 8A). Therefore, noise reduction would be identical from its mirror image position, and specular performance would favor the opposite direction from its mirror image. The noise reduction coefficient would be the same from its mirror image position since the same surface area of the perforated acoustic surface (26A-26D) is exposed. However, the tunable insert (14) has the direction of the non-acoustic side (24) facing the opposite direction (the same angle from the vertical axis but facing the opposite direction), meaning that specular reflection of the sound would favor the opposite direction.

Figure 10B:
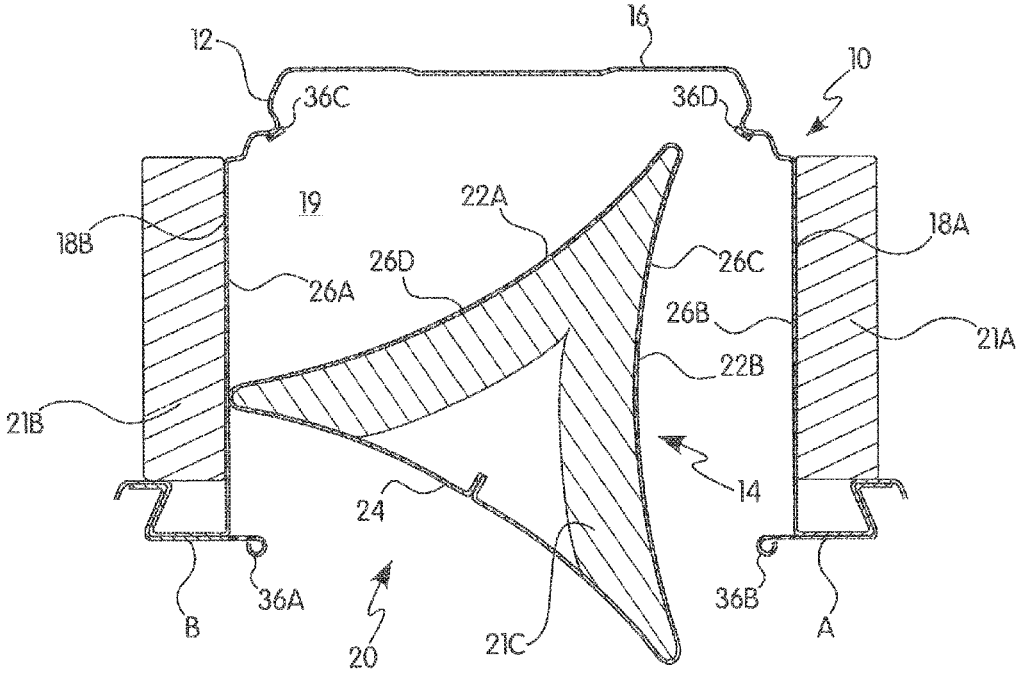
FIG. 10B shows a cross-sectional view of one embodiment of the tunable insert in its 7 o'clock down position.

FIG. 10B shows the tunable insert (14) in the 7 o'clock down position. This position is a mirror image of the 5 o'clock down position (i.e., the tunable insert (14) shown in FIG. 10B is flipped about the vertical axis compared to the tunable insert (14) in FIG. 8B). Therefore, noise reduction would be identical from its mirror image position, and specular performance would favor the opposite direction from its mirror image.

Figure 11A:
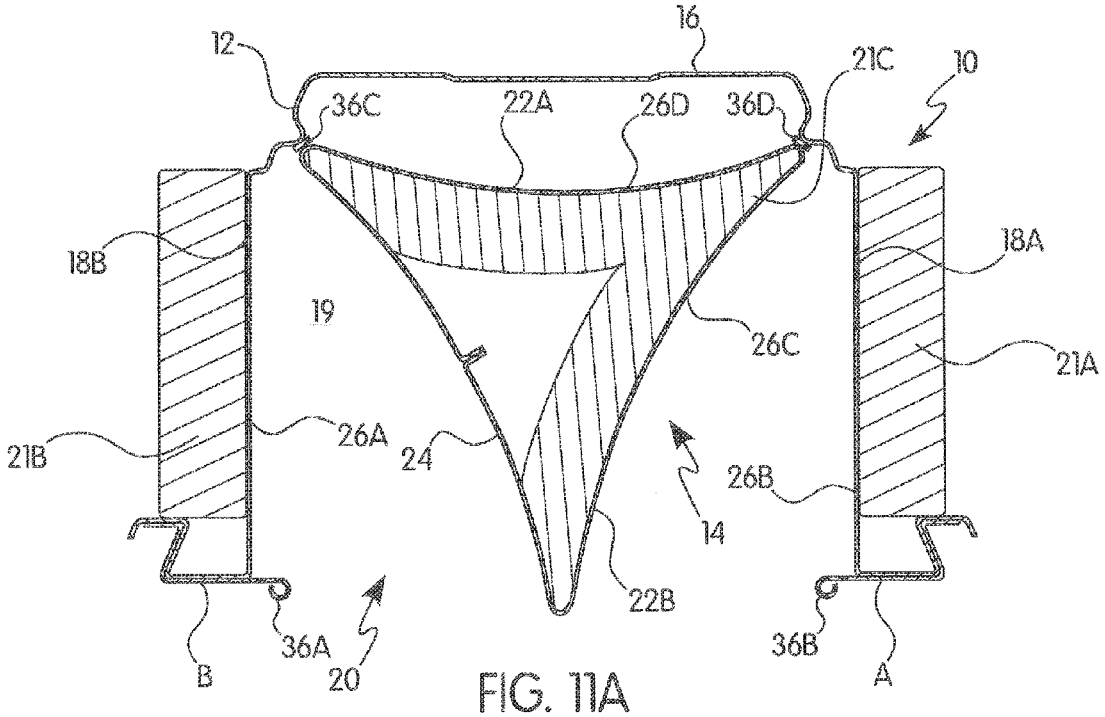
FIG. 11A shows a cross-sectional view of one embodiment of the tunable insert in its 8 o'clock up position.

FIG. 11A shows the tunable insert (14) in the 8 o'clock up position. This position is the mirror image of the 4 o'clock up position (i.e., the tunable insert (14) shown in FIG. 11A is flipped about the vertical axis compared to the tunable insert (14) in FIG. 7A). Therefore, noise reduction would be identical from its mirror image position, and specular performance would favor the opposite direction from its mirror image.

Figure 11B:
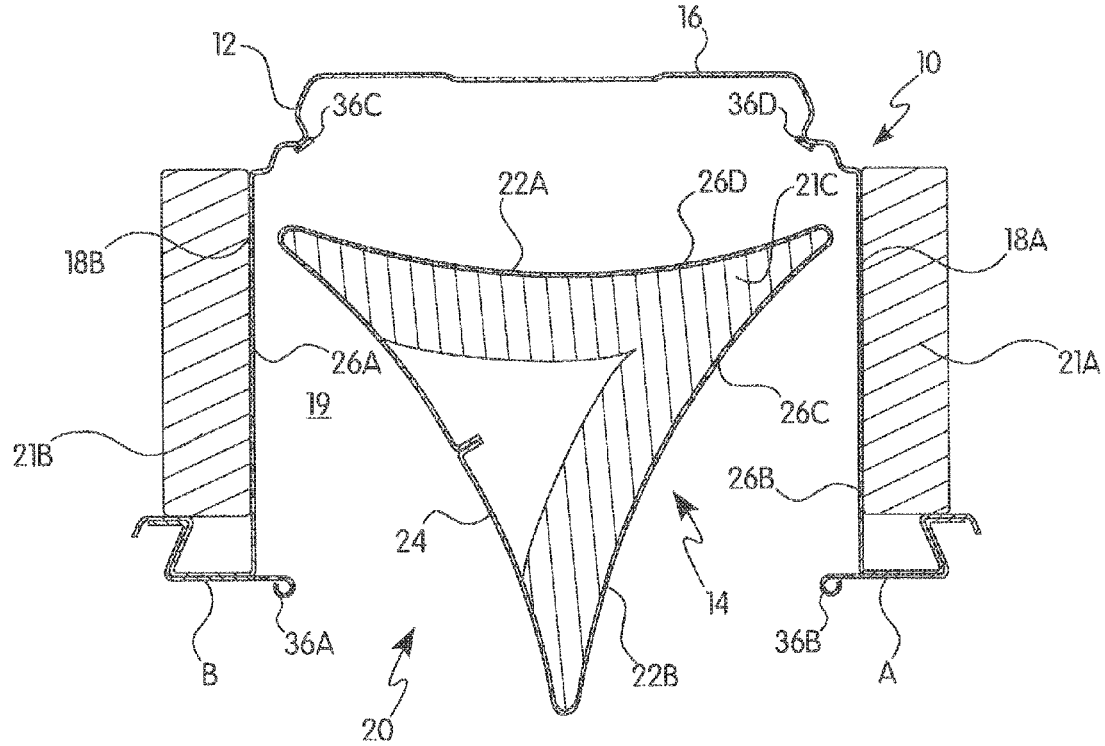
FIG. 11B shows a cross-sectional view of one embodiment of the tunable insert in its 8 o'clock down position.

FIG. 11B shows the tunable insert (14) in the 8 o'clock down position. This position is the mirror image of the 4 o'clock down position (i.e., the tunable insert (14) shown in FIG. 11B is flipped about the vertical axis compared to the tunable insert (14) in FIG. 7B). Therefore, noise reduction would be identical from its mirror image position, and specular performance would favor the opposite direction from its mirror image.

Figure 12A:
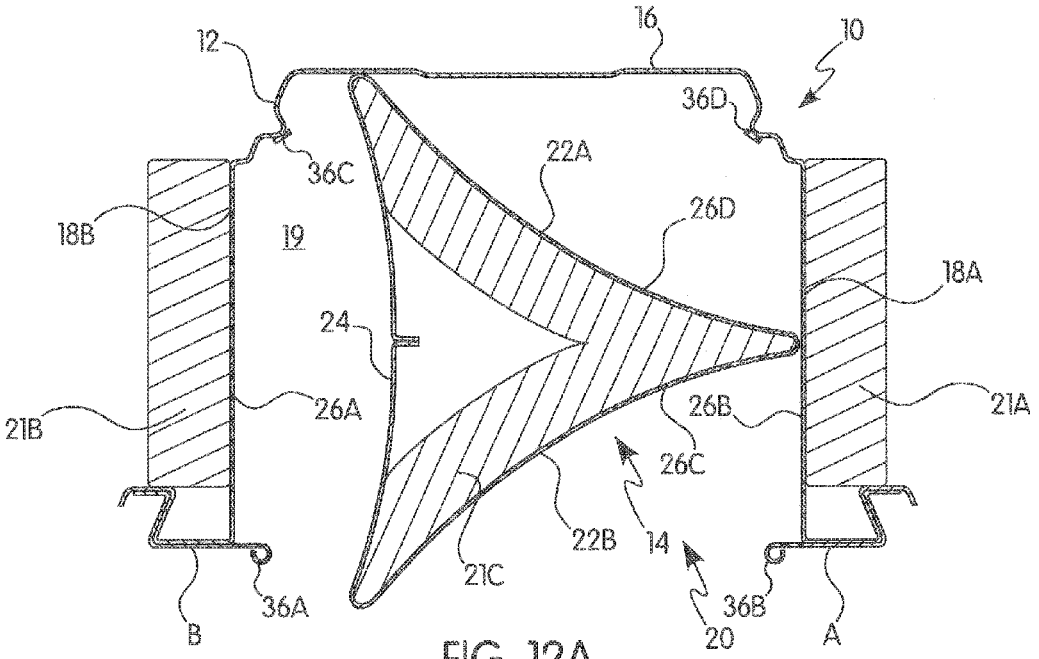
FIG. 12A shows a cross-sectional view of one embodiment of the tunable insert in its 9 o'clock mid position.

FIG. 12A shows the tunable insert (14) in the 9 o'clock mid position. This position is the mirror image of the 3 o'clock mid position (i.e., the tunable insert (14) shown in FIG. 12A is flipped about the vertical axis compared to the tunable insert (14) in FIG. 6A). Therefore, noise reduction would be identical from its mirror image position, and specular performance would favor the opposite direction from its mirror image.

Figure 12B:
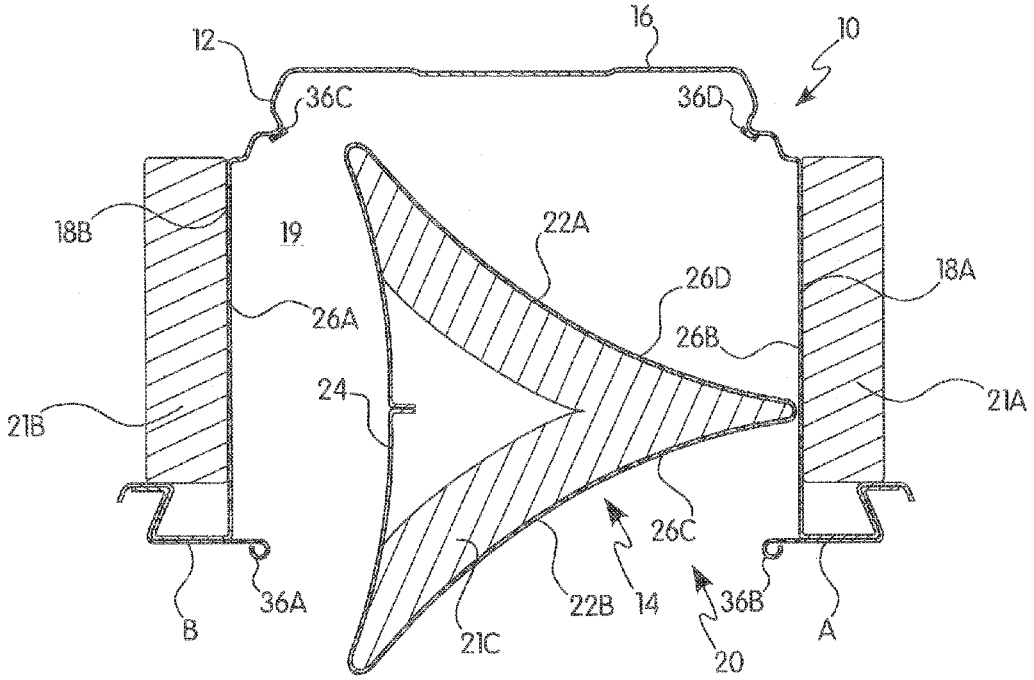
FIG. 12B shows a cross-sectional view of one embodiment of the tunable insert in its 9 o'clock down position.

FIG. 12B shows the tunable insert (14) in the 9 o'clock down position. This position is the mirror image of the 3 o'clock down position (i.e., the tunable insert (14) shown in FIG. 12B is flipped about the vertical axis compared to the tunable insert (14) in FIG. 6B). Therefore, noise reduction would be identical from its mirror image position, and specular performance would favor the opposite direction from its mirror image.

Figure 13:
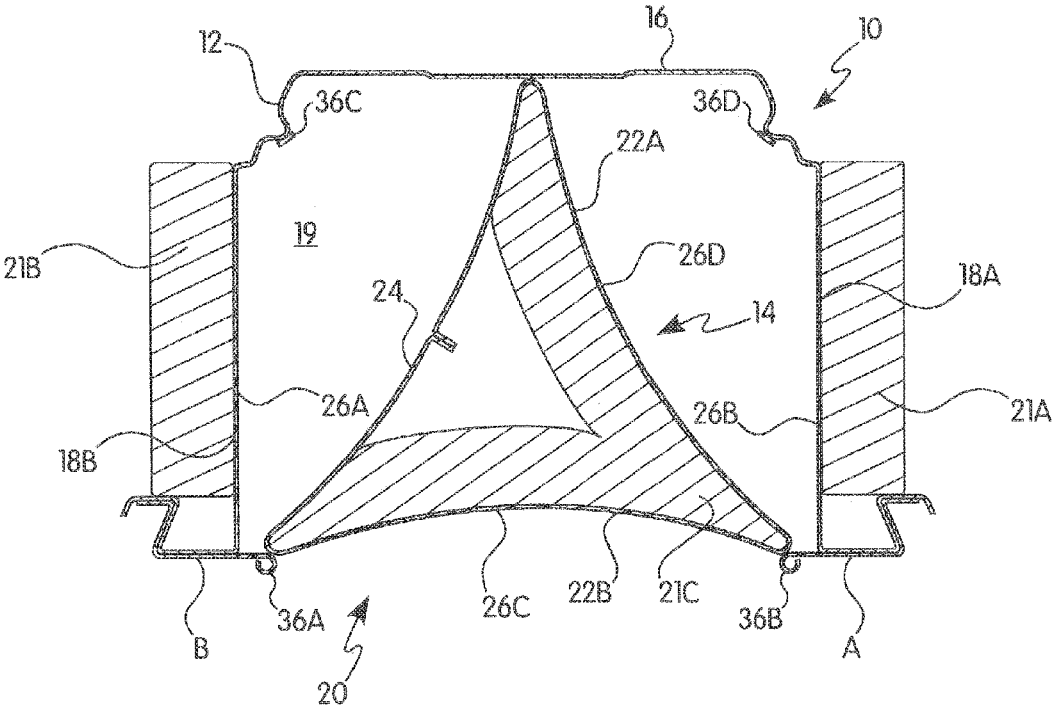
FIG. 13 shows a cross-sectional view of one embodiment of the tunable insert in its 10 o'clock position.

FIG. 13 shows the tunable insert (14) in the 10 o'clock position. This position is the mirror image of the 2 o'clock position (i.e., the tunable insert (14) shown in FIG. 13 is flipped about the vertical axis compared to the tunable insert (14) in FIG. 5). Therefore, noise reduction would be identical from its mirror image position, and specular performance would favor the opposite direction from its mirror image. The tunable insert (14) shown in FIG. 13 may rotate or translate by bending seal portions (36A, 36B) of the connector portions (A, B) as previously described.

Figure 14A:
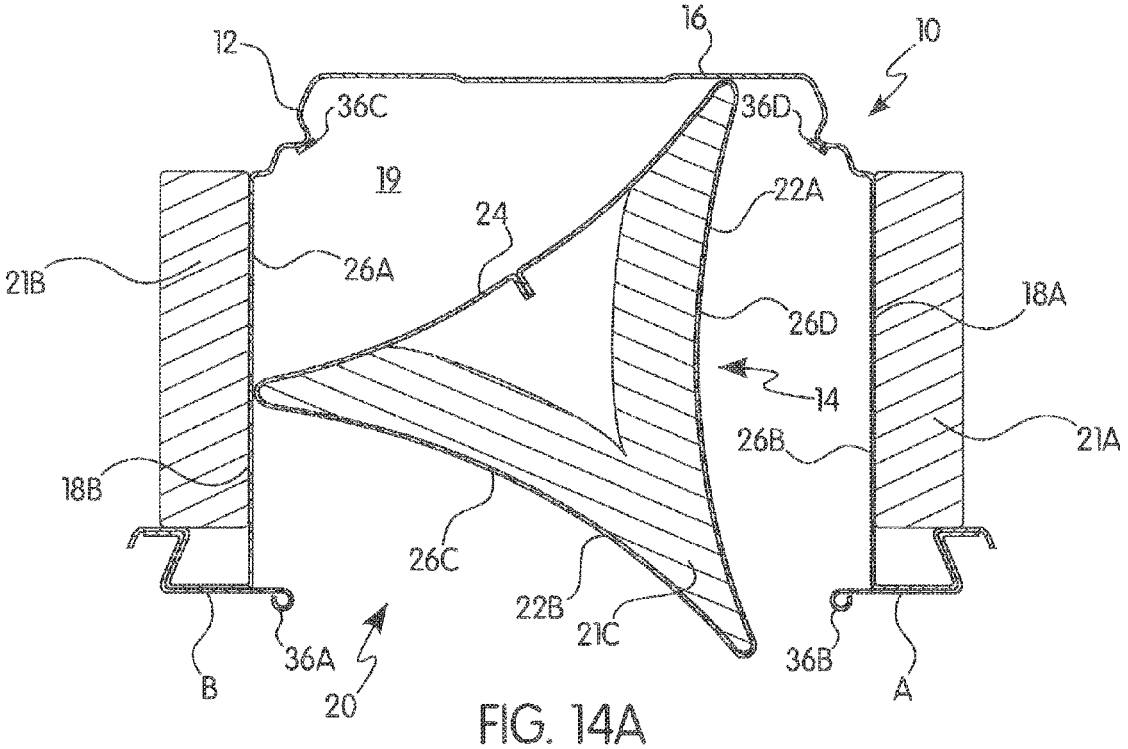
FIG. 14A shows a cross-sectional view of one embodiment of the tunable insert in its 11 o'clock mid position.

FIG. 14A shows the tunable insert (14) in the 11 o'clock mid position. This position is the mirror image of the 1 o'clock mid position (i.e., the tunable insert (14) shown in FIG. 14A is flipped about the vertical axis compared to the tunable insert (14) in FIG. 4A). Therefore, noise reduction would be identical from its mirror image position, and specular performance would favor the opposite direction from its mirror image.

Figure 14B:
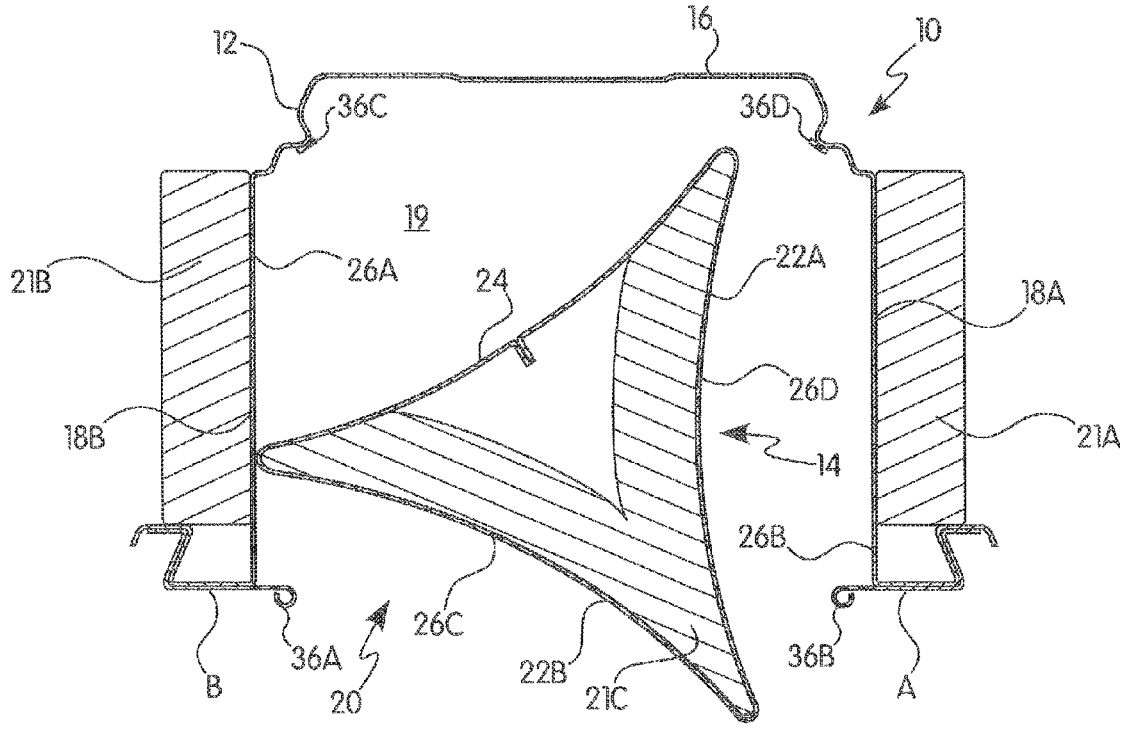
FIG. 14B shows a cross-sectional view of one embodiment of the tunable insert in its 11 o'clock down position.

FIG. 14B shows the tunable insert (14) in the 11 o'clock down position. This position is the mirror image of the 1 o'clock down position (i.e., the tunable insert (14) shown in FIG. 14B is flipped about the vertical axis compared to the tunable insert (14) in FIG. 4B). Therefore, noise reduction would be identical from its mirror image position, and specular performance would favor the opposite direction from its mirror image.

Figure 15:
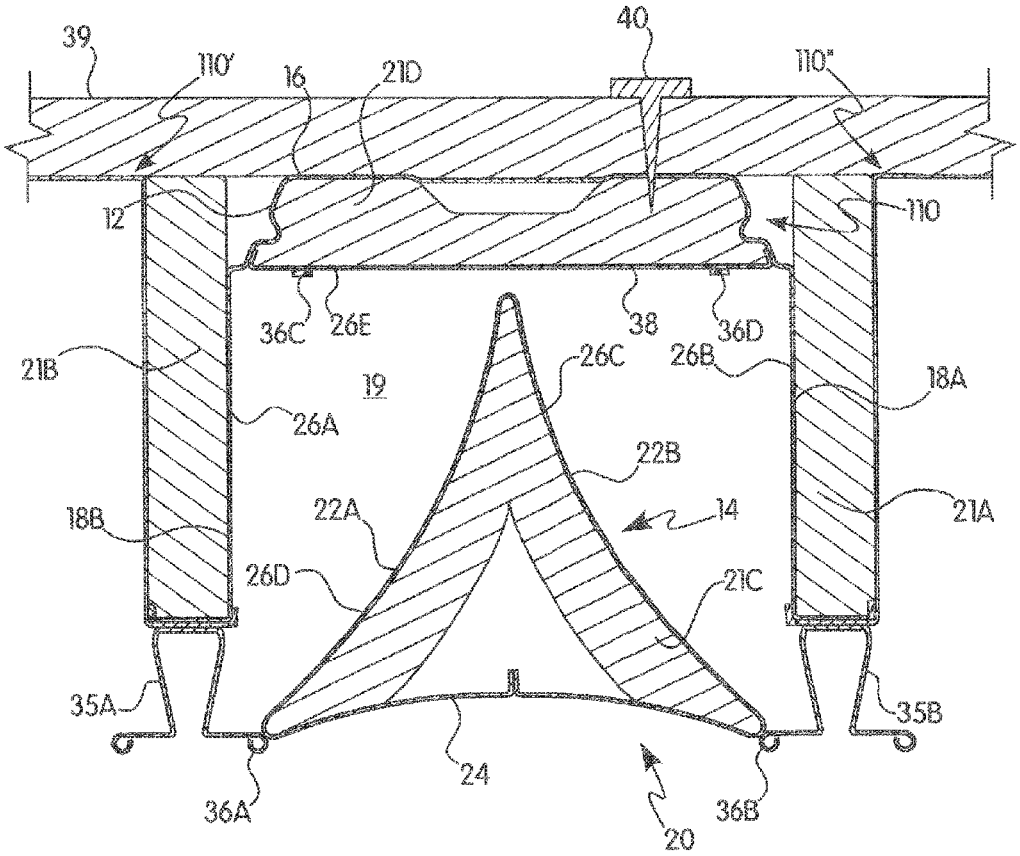
FIG. 15 shows a cross-sectional view of one embodiment of the acoustic deck having a deck member and the tunable insert according to the present invention.

Referring to FIG. 15, the deck members (12) can be installed in the acoustic deck (110) with web extensions (35A, 35B). The web extension (35A) can cooperate with an adjacent web extension (35B) to provide closure at the opening (20) of the deck member (12) when seals (36A, 36B) of the web extensions (35A, 35B) come into contact with the tunable insert (14). The acoustic deck (110', 110") may be fastened to the web extensions (35A, 35B), such as using roofing screws. The acoustic deck (110) can be arranged interlockably with other acoustic decks (110', 110") in an adjacent side-by-side configuration (i.e., multiple deck members (12) interlock with one another). Any type of interlocking arrangement for adjacent decking (110', 110") can be used, such as the interlocking arrangement shown in FIG. 1, FIG. 15, or any other conceivable interlocking arrangement. The adjacent acoustic decks (10', 110', 110") can be the same shape as the acoustic deck (10, 110) (see FIG. 1) or they can be a different shape (see FIG. 15). The web extensions (35A, 35B) can also absorb or reflect sound waves based on the shape of the web extensions (35A, 35B). Acoustic decks (110, 110', 110") are the same as acoustic deck (10) except for the below noted differences. As shown in FIG. 15, the deck members (12) can be installed to rest on top of the web extensions (35A, 35B) and can be attached to the web extensions (35A, 35B) by any known arrangement such as fasteners, such as by screws or bolts, such as by welding, such as by adhesives, etc.

With continued reference to FIG. 15, the acoustic deck (110) can further include at least one seal ((36A, 36B)) disposed on the web extensions (35A, 35B). The seals (36A, 36B) can be in contact with the tunable insert (14). When sound waves pass a point proximate the contact point of the seal (36A, 36B) and the tunable insert (14), the sound waves can be affected. For instance, theses sound waves can be dampened. The seals (36A, 36B) can be disposed on the web extensions (35A, 35B) outside the cavity (19) of the deck member (12). This embodiment includes two seals (36A, 36B), one on each of the web extensions (35A, 35B). One or multiple seals (36A, 36B) can be in contact with the tunable insert (14). Alternatively, the tunable insert (14) can be positioned so as not to be in contact with the seals (36A, 36B) The seals (36A, 36B) can be made of rubber or other elastic material. Additionally, at least one seal (36C, 36D) can be positioned on the stationary insert (38) in the deck member (12) and can contact the tunable insert (14) as the tunable insert (14) is moved toward the stationary insert (38).

With continued reference to FIG. 15, the stationary insert (38) can be positioned in the cavity (19) between the base (16) and the opening (20). In some embodiments, the stationary insert (38) can be in contact with the side walls (18A, 18B) and be positioned substantially parallel with the base (16). In some embodiments, the stationary insert (38) is a perforated acoustic surface (26E), and absorption material (21D) can be provided between the stationary insert (38) and the base (16) (e.g., below the base (16) but above the stationary insert (38)). This arrangement can be employed to improve the acoustics in an otherwise unusable space that, in some instances, is reserved for the penetration of roof thermal insulation board (39) spikes (40) In some situations, roof spikes (40) are nailed into the base (16) of the deck member (12) (as shown in FIG. 15). This arrangement also includes a motor (30) and a controller (34) to cause rotation of the tunable insert (14) as previously described.

Figure 16:
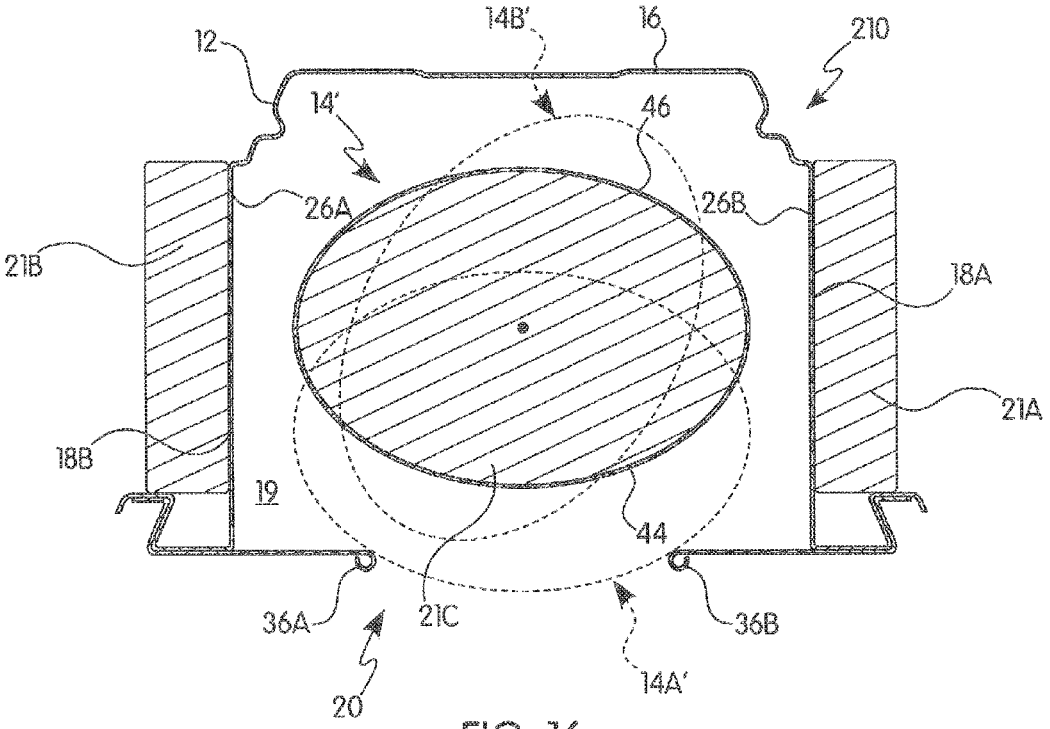
FIG. 16 shows a cross-sectional view of one embodiment of the tunable insert as a curvilinear shape according to the present invention.
Figure 17A:
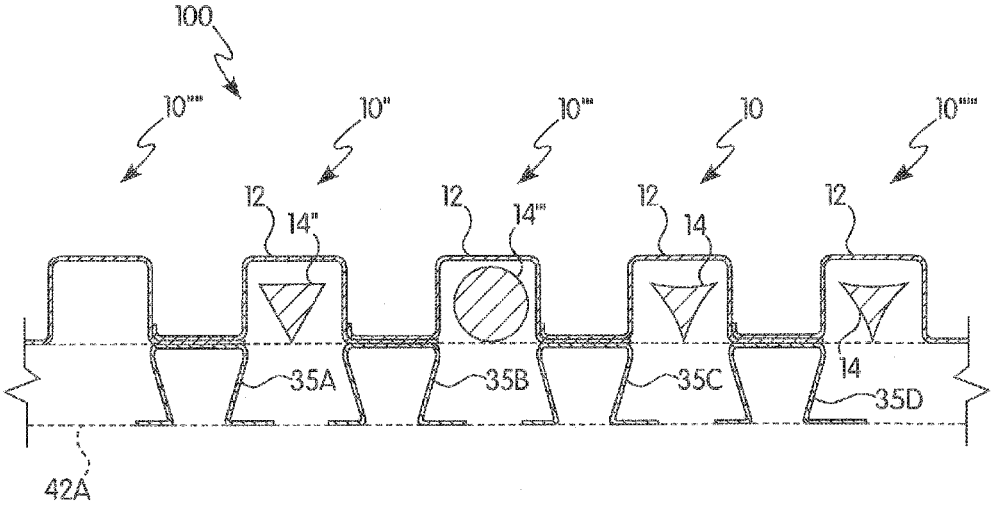
FIG. 17A shows a cross-sectional view from the front of one embodiment of an acoustic deck system having an acoustic deck resting on a beam.

Referring to FIGS. 16-17A, alternate, non-limiting shapes of the tunable insert (14) are illustrated In one embodiment of the acoustic deck (210), shown in FIG. 16, the cross section of the tunable insert (14') can be a curvilinear shape. The tunable insert (14A', 14B') in FIG. 16 can be rotatable. The cross section of the tunable insert (14', 14'") can be a circle or can be an oval shape (i.e., the tunable insert (14', 14'") is a cylinder). In one embodiment, the tunable insert (14', 14'") can include a perforated curve (44) and a non-perforated curve (46). The perforated curve (44) is a section of the surface of the tunable insert (14') that is a perforated acoustic surface (26) (as the previously-described acoustic side (22A, 22B)). The non-perforated curve (46) is a section of the surface of the tunable insert (14') that is identical to the previously-described non-acoustic side (24). As shown in FIG. 16, half of the tunable insert (14') can be the perforated curve (44), while the other half is the non-perforated curve (46). However, different amounts of the surface of the tunable insert (14') can be the perforated curve (44). For instance, the entire surface of the tunable insert (14') can be the perforated curve (44); in contrast, none of the surface of the tunable insert (14') can be the perforated curve (44) (i.e., the entire surface of the tunable insert (14") is the non-perforated curve (46)). Sound absorption material (21C) can co-act with the tunable insert (14'). The tunable insert (14) is also rotatable 360 degrees and can be translated as well. This arrangement also includes a motor (30) and a controller (34) to cause rotation of the tunable insert (14) as previously described. The embodiment shown in FIG. 16 can include seals (36A, 36B) as described in previous embodiments.

Referring to FIG. 17A, other alternate, non-limiting shapes of the tunable insert (14) are illustrated which are additional potential designs of the tunable insert (14', 14'") from the previously described three-sided tunable insert (14) with concave sides (see FIGS. 1 and 3-15). In one embodiment, a cross section of the tunable insert (14") is a triangle and is configured as an equilateral triangle with planar (uncurved) sides. Based on the shapes previously described, it is clear that a tunable insert (14, 14', 14", 14'") of any shape can be used in this invention. This includes a tunable insert (14) that has a cross section that is a polygon e.g., quadrilateral, pentagon, hexagon, etc.), or a tunable insert (14) of any other customizable shape. In addition, the sides of the cross section of the tunable insert (14) can be planar, curved, or some combination thereof. Further, FIG. 17A shows a plurality of acoustic decks (10, 10", 10'", 10"", 10'"") connected to each other to form an acoustic deck system (100). It should be noted that the acoustic deck system (100) can include deck members (12) without any of the tunable inserts (14) so that the tunable inserts (14) can be strategically placed in a structure. Therefore, the deck system (100) just needs at least one of the deck members (12) having a tunable insert (14).

Figure 17B:
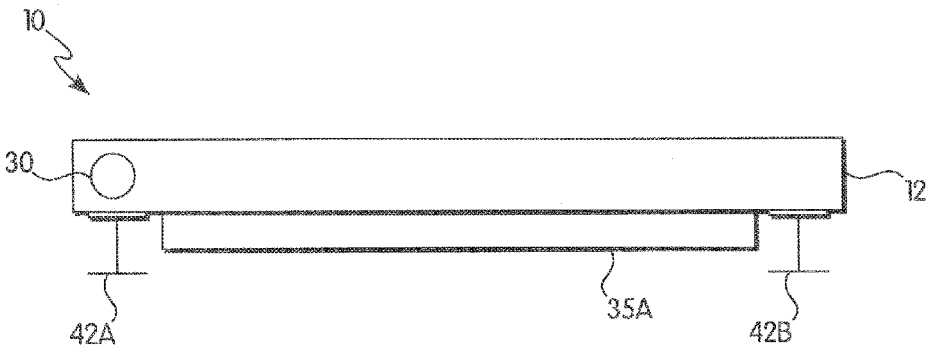
FIG. 17B shows a view from the side of one embodiment of the acoustic deck having a deck member resting on a beam.

Referring to FIGS. 17A-17B, the acoustic deck system (100) can be installed to rest on beams (42A). The beams (42A) can be I-beams. The deck members (12) can be placed on the web extensions (35A-35D) and can be attached to the web extensions (35A-35D) using any of the previously described means. In one embodiment, the web extensions (35A-35D) do not contact the beams (42A). Instead, the deck members (12) rest on the beams (42A) and can be fastened to the beams (42A) by any attachment means described above. The beams (42A) can be spaced apart so as to provide adequate support while still allowing the sound waves to interact with the web extensions (35A-35D) and the deck members (12) to yield the desired acoustic properties in the room.

Figure 18A:
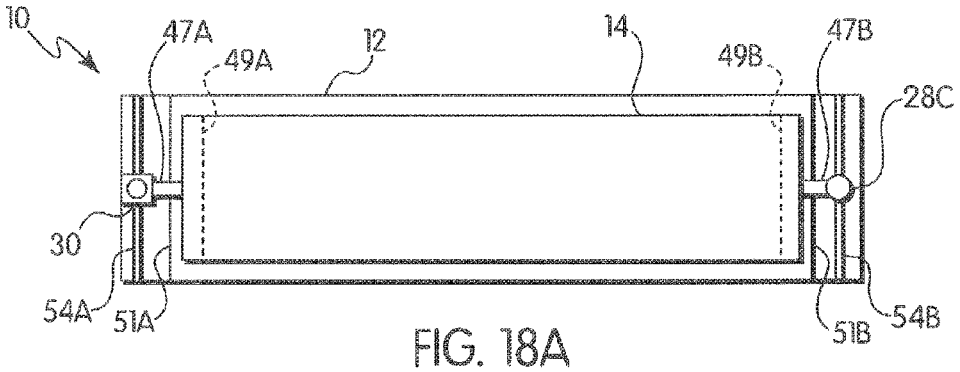
FIG. 18A shows a schematic view of a system to rotate the tunable insert and to move the tunable insert vertically.

Referring to FIG. 18A, the tunable insert (14) can be rotated about an axis. In one embodiment, stub shafts (47A, 47B) can be provided that extend from end plates (49A, 49B) of the tunable insert (14). The stub shaft (47B) can be attached to a bearing (28C) which is mounted in the end plate (54A) of the deck member (12) on a second end of the tunable insert (14). On a first end of the tunable insert (14), the stub shaft (47A) can co-act with a motor (30) which is mounted in the end plate (54B) of the deck member (12). This motor (30) can be, for instance, a gear motor and can rotate (relative to the deck member (12)) the stub shaft (47A)

which, in turn, rotates the tunable insert (14) itself. The stub shaft (47A) can be rotatable 360 degrees so that the tunable insert (14) can also perform complete 360 degree rotations. The tunable insert (14) can be rotatable relative to the deck member (12) between a plurality of positions. Aesthetic covers (51A, 51B) can be included to conceal the drive mechanism (including the motor (30)).

Figure 18B:
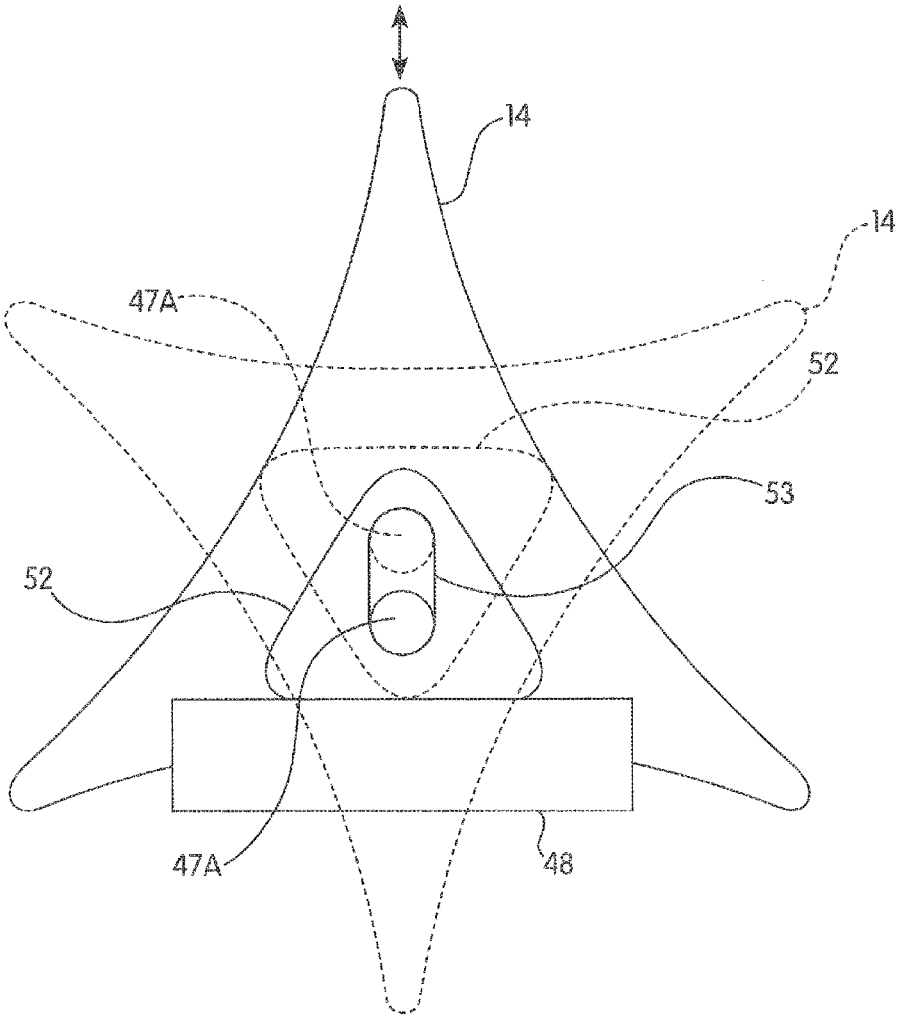

In one embodiment, shown in FIG. 18B, the tunable insert (14) is translatable (e.g., along the y-axis) using a cam arrangement that includes a cam block (48) co-acting with a rotating cam (52). The stub shaft (47A) can be included in an elongated slot (53) with the bearing (28A, 28B, 28C), which are mounted in the end plates (54A, 54B) (see the beatings 28A or 28B from FIG. 2 or 28C from FIG. 18A), and the elongated slot (53) allows the stub shaft (47A) to translate along an axis as the tunable insert (14) is rotated. The elongated slot (53) can be any suitable shape to let the stub shaft (47A) move in the direction necessary to permit translation of the tunable insert (14). For instance, the elongated slot (53) can be elliptical-shaped. In one embodiment, the rotating cam (52) has a cross-section that is substantially triangular in shape. Rotating the rotating cam (52) causes the rotating cam (52) to co-act with the cam block (48) to translate the tunable insert (14), such as up or down, based on the shape of the rotating cam (52). As shown in FIG. 18B, the tunable insert (14) is translated upward by the rotation of the rotating cam (52) co-acting with the cam block (48), the stub shaft (47A) is translated up within the elongated slot (53). Conversely, if the tunable insert (14) is translated downward by the rotation of the rotating cam (52) co-acting with the cam block (48), the stub shaft (47A) is translated down within the elongated slot (53). The drawings show the tunable insert (14) in its highest (see e.g., FIG. 3A) and lowest position (see e.g., FIG. 5). The configuration shown in FIG. 18B can be used to translate the tunable insert (14) within the cavity (19) of the acoustic deck (10).

Figure 18C:
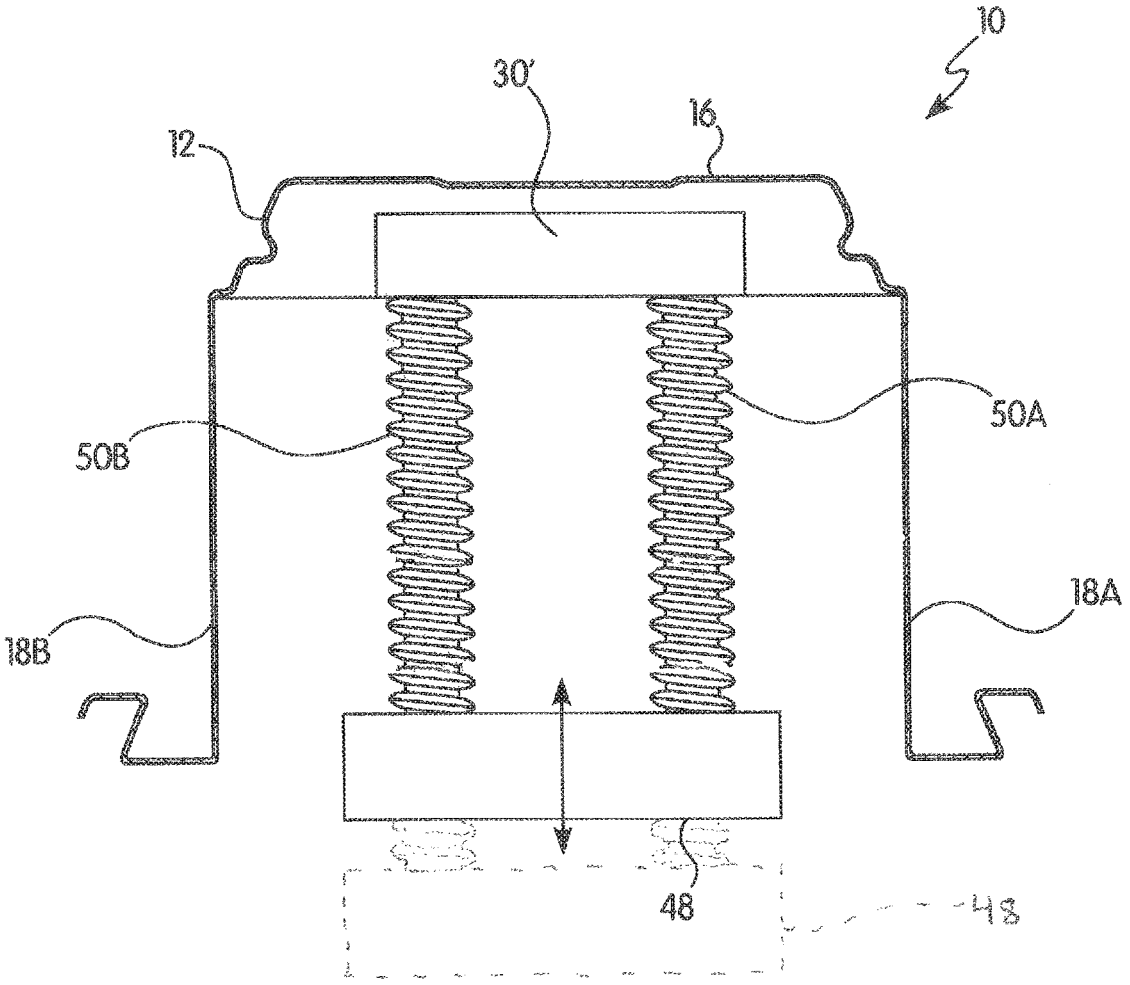
FIG. 18C shows a schematic view of motorized lead screws to extend the translation of the tunable insert outside the deck cavity.

Referring to FIG. 18C, another configuration for translating the tunable insert (14) is provided. The configuration in FIG. 18C can be used for translation of the tunable insert (14) outside of the cavity (19) of the acoustic deck (10). The cam block (48) can be translated even farther outside the cavity (19) from the configuration shown in FIG. 18C, such as so that the cam block (48) is fully outside the cavity (19). Lead screws (50A, 50B) can be provided to connect to the cam block (48) on one end. On the other end, the lead screws (50A, 50B) can co-act with a motor (30'). The motor (30') can turn the lead screws (50A, 50B) to translate the cam block (48) (and ultimately the tunable insert (14) (not shown)). One motor (30') or multiple motors (30') can turn the lead screws (50A, 50B) in any manner suitable to translate the cam block (48).

The system pictured in FIGS. 18A-18C, and also in FIG. 2, for rotating and/or translating the tunable insert (14) are simply exemplary embodiments of a system for rotating and/or translating the tunable insert (14), and any suitable system can be implemented into the acoustic deck (10) of the present invention.

Notably, in addition to altering the acoustic properties of a room, rotating and translating the tunable insert (14) can also be done to change the appearance of the acoustic deck (10) in the room.

The acoustic deck (10) described above can be used in a roof deck/acoustic ceiling embodiment, as illustrated in the drawings, but the acoustic deck (10) can be adapted for use as a floor deck/acoustical ceiling arrangement. The configuration having the side walls (18A, 18B) including perforating (perforated acoustic surfaces (26A, 26B)) and co-acting with the absorption material (21A, 21B) can be employed for the roof deck/acoustical ceiling embodiment. For the floor deck/acoustical ceiling embodiment, a configuration having side walls (18A, 18B) can be employed without the side walls (18A, 18B) having perforated acoustic surfaces (26A, 26B) or co-acting with absorption material (21A, 21B).

Although the invention has been described in detail for the purpose of illustration based on what is currently considered to be the most practical and preferred embodiments, it is to be understood that such detail is solely for that purpose and that the invention is not limited to the disclosed embodiments, but, to the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An acoustic deck comprising:

a deck member defining a cavity; and a tunable insert disposed at least partially within the cavity of the deck member, wherein the tunable insert is movable relative to the deck member along two axes, a first axis running longitudinally along the tunable insert and disposed within the cavity during rotation of the tunable insert, wherein the insert is rotatable 360° about the first axis, and a second axis intersecting the first axis, wherein the insert is translatable along the second axis.

2. The acoustic deck of claim 1, wherein the deck member comprises a plurality of side walls and a base connecting the side walls, wherein each of the side walls include a distal end portion, wherein the side walls and the base define the cavity, wherein the base is positioned opposite an opening defined between the respective distal end portions of the side walls.

3. The acoustic deck of claim 2, wherein the deck member further comprises a stationary insert positioned between the base and the opening.

4. The acoustic deck of claim 2, wherein the side walls comprise a perforation.

5. The acoustic deck of claim 4, further comprising acoustic absorption material co-acting with the base or the side walls.

6. The acoustic deck of claim 1, wherein the deck member comprises a seal proximate the opening, whereby when the seal is in contact with the tunable insert, sound waves that pass proximate the contact point of the seal and the tunable insert are affected.

7. The acoustic deck of claim 3, wherein acoustic absorption material is positioned between the stationary insert and the base.

8. The acoustic deck of claim 1, wherein a cross section of the tunable insert is three-sided.

9. The acoustic deck of claim 8, wherein a side of the tunable insert comprises a perforation.

10. The acoustic deck of claim 9, wherein the tunable insert comprises acoustic absorption material co-acting with the tunable insert.

11. The acoustic deck of claim 8, wherein a side of the tunable insert is planar.

12. The acoustic deck of claim 8, wherein a side of the tunable insert is curved.

13. The acoustic deck of claim 1, wherein the tunable insert is cylindrical shaped.

14. The acoustic deck of claim 13, wherein the tunable insert comprises a perforation.

15. The acoustic deck of claim 1, further comprising a motor co-acting with the tunable insert to rotate the tunable insert relative to the deck member.

16. The acoustic deck of claim 15, wherein the tunable insert is rotatable 360 degrees relative to the deck member.

17. The acoustic deck of claim 15, wherein the tunable insert is rotatable relative to the deck member between a plurality of set positions.

18. The acoustic deck of claim 15, further comprising a controller in electrical communication with the motor configured to control rotation of the tunable insert relative to the deck member to a desired position.

19. The acoustic deck of claim 1, wherein the acoustic deck comprises a bracket coupled to the tunable insert and configured to allow translation of the tunable insert along an axis relative to the deck member.

20. The acoustic deck of claim 1, wherein the deck member is configured to interlock with other deck members.

21. An acoustic deck system comprising a plurality of deck members, wherein at least one of the deck members define a cavity and a tunable insert is disposed at least partially within the cavity, and wherein the tunable insert is movable relative to the at least one deck member along two axes, a first axis running longitudinally along the tunable insert and disposed within the cavity during rotation of the tunable insert, wherein the insert is rotatable 360° about the first axis, and a second axis intersecting the first axis, wherein the insert is translatable along the second axis.

22. A method of operating an acoustic deck comprising:

rotating or translating a tunable insert disposed at least partially within a deck member, wherein the deck member defines a cavity, wherein the tunable insert is rotated or translated relative to the deck member along two axes, a first axis running longitudinally along the tunable insert and disposed within the cavity during rotation of the tunable insert, wherein the insert is rotatable 360° about the first axis, and a second axis intersecting the first axis, wherein the insert is translatable along the second axis, thereby affecting the acoustic effects of the acoustic deck.

23. The acoustic deck of claim 1, wherein the tunable insert is rotatable relative to the deck member.

24. The acoustic deck of claim 1, wherein the tunable insert is translatable relative to the deck member.

25. The acoustic deck of claim 1, wherein the acoustic deck is a structural metal roof or floor deck integral with a building structure and configured to support roof or floor loads.

* * * * *